US008211357B2

(12) United States Patent
Hayton

(10) Patent No.: US 8,211,357 B2
(45) Date of Patent: Jul. 3, 2012

(54) SMELTING APPARATUS

(75) Inventor: Mark Hayton, Bateman (AU)

(73) Assignee: Technological Resources Pty. Limited, Melbourne (AU)

( * ) Notice: Subject to any disclaimer, the term of this patent is extended or adjusted under 35 U.S.C. 154(b) by 776 days.

(21) Appl. No.: 11/658,576

(22) PCT Filed: Jul. 27, 2005

(86) PCT No.: PCT/AU2005/001101

§ 371 (c)(1),
(2), (4) Date: Nov. 18, 2008

(87) PCT Pub. No.: WO2006/010208

PCT Pub. Date: Feb. 2, 2006

(65) Prior Publication Data

US 2009/0065984 A1 Mar. 12, 2009

(30) Foreign Application Priority Data

Jul. 27, 2004 (AU) ..... 2004904199

(51) Int. Cl.
*C21B 7/16* (2006.01)

(52) U.S. Cl. ..... 266/47; 266/225; 266/226

(58) Field of Classification Search ..... 266/44, 266/47, 225, 226

See application file for complete search history.

(56) References Cited

U.S. PATENT DOCUMENTS

| | | | | |
|---|---|---|---|---|
| 3,439,912 | A * | 4/1969 | Berger | 266/226 |
| 3,549,139 | A * | 12/1970 | Marxen | 266/226 |
| 3,968,956 | A | 7/1976 | Sugiura et al. | |
| 4,247,086 | A | 1/1981 | Hepler, Jr. | |
| 4,533,125 | A | 8/1985 | Mailliet et al. | |
| 4,941,792 | A | 7/1990 | Cimenti et al. | |
| 5,167,904 | A | 12/1992 | Stomp et al. | |
| 5,200,136 | A | 4/1993 | Ramaseder et al. | |
| 5,301,928 | A | 4/1994 | Stomp et al. | |
| 5,374,296 | A | 12/1994 | Jones | |
| 6,267,799 | B1 | 7/2001 | Innes et al. | |
| 6,322,745 | B1 | 11/2001 | Leigh et al. | |
| 6,398,842 | B2 | 6/2002 | Dunne | |
| 6,440,356 | B2 | 8/2002 | Dunne | |
| 6,565,798 | B2 | 5/2003 | Gurr et al. | |

FOREIGN PATENT DOCUMENTS

| | | |
|---|---|---|
| WO | WO 96/31627 | 10/1996 |
| WO | WO 00/01854 | 1/2000 |

* cited by examiner

*Primary Examiner* — Scott Kastler

(74) *Attorney, Agent, or Firm* — Finnegan, Henderson, Farabow, Garrett & Dunner, LLP

(57) ABSTRACT

A metallurgical vessel (11) has circumferentially spaced tubular mountings (25) through which to extend solids injection lances (31) into the vessel. Lance extraction apparatus (33) comprises an elongate track support structure (41) supporting a twin rail track (40) inclined upwardly and outwardly from the vessel above the direction of inclination of a respective lance (31). Interconnected upper and lower carriages (42, 44) are moveable along track (40) by operation of a hoist (47). Extraction apparatus (33) is operable sequentially to remove solids delivery line sections (36) and (37) and the lance (31) by connection to the carriages (42, 44) and upward movement of those carriages along track (40). Upper carriage (42) carries a pivot arm (51) for connection to upper parts of components to be removed such that those components can be pivoted downwardly to positions in which they can be hung from an overhead crane for removal to a remote location.

23 Claims, 21 Drawing Sheets

SMELTING APPARATUS

TECHNICAL FIELD

The present invention relates to smelting methods and apparatus. The invention has particular but not exclusive application to smelting apparatus within which to perform direct smelting to produce molten metal in pure or alloy form from a metalliferous feed material such as ores, partly reduced ores and metal-containing waste streams.

A known direct smelting process, which relies principally on a molten metal layer as a reaction medium, and is generally referred to as the HIsmelt process, is described in U.S. Pat. No. 6,267,799 and International Patent Publication WO 96/31627 in the name of the applicant. The HIsmelt process as described in these publications comprises:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also comprises post-combusting reaction gases, such as CO and $H_2$ released from the bath, in the space above the bath with oxygen-containing gas and transferring the heat generated by the post-combustion to the bath to contribute to the thermal energy required to smelt the metalliferous feed materials.

The HIsmelt process also comprises forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. To promote the post combustion of reaction gases in the upper part of the vessel, a blast of hot air, which may be oxygen enriched, is injected into the upper region of the vessel through the downwardly extending hot air injection lance. Offgases resulting from the post-combustion of reaction gases in the vessel are taken away from the upper part of the vessel through an offgas duct.

The HIsmelt process enables large quantities of molten metal to be produced by direct smelting in a single compact vessel. This vessel must function as a pressure vessel containing solids, liquids and gases at very high temperatures throughout a smelting operation which can be extended over a long period. As described in U.S. Pat. No. 6,322,745 and International Patent Publication WO 00/01854 in the name of the applicant the vessel may consist of a steel shell with a hearth contained therein formed of refractory material having a base and sides in contact with at least the molten metal and side walls extending upwardly from the sides of the hearth that are in contact with the slag layer and the gas continuous space above, with at least part of those side walls consisting of water cooled panels. Such panels may be of a double serpentine shape with rammed or gunned refractory interspersed between.

The metallurgical vessel for performing the HIsmelt process presents unique problems in that the process operates continuously, and the vessel must be closed up as a pressure vessel for long periods, typically of the order of a year or more and then must be quickly relined in a short period of time as described in U.S. Pat. No. 6,565,798 in the name of the applicant.

Before refurbishment of the vessel can proceed it is necessary to extract all of the solids injection lances from the vessel and remove them to a safe location. Moreover, individual lances may need to be withdrawn for repair and/or replacement between major refurbishments of the vessel. In a typical commercial smelting plant the lances may be in excess of 5 meters long and, being of long slender construction, but of very significant weight, they need to be adequately supported during the extraction process until they can be brought to an upright configuration in which they can be hung from an overhead crane or hoist. There will generally also be solids delivery lines for delivery of solids material to the lances and these must firstly be removed before extraction of the lances can proceed.

DISCLOSURE OF THE INVENTION

According to the invention, there is provided smelting apparatus comprising:

a metallurgical vessel;

at least one elongate solids injection lance extending through a side wall of the vessel with downwards and inwards inclination for delivery of solids material into the vessel;

an elongate track extending upwardly and outwardly from the side wall of the vessel;

carriage means moveable along the track; and carriage drive means operable to move the carriage means along the track, the carriage means being connectable to the lance to enable the lance to be supported from the track and moved upwardly and outwardly by operation of the carriage drive means and thereby extracted from the vessel.

The track may be disposed adjacent and parallel with the direction of inclination of the lance. It may for example be disposed above the direction of inclination of the lance and may comprise parallel rails.

The apparatus may further comprise lance connector means for connecting the lance to the carriage means so as to be supported through the carriage means from the track.

The lance connector means may be operable to allow the connected lance to be lowered from an initial inclined position extending parallel with the track to a generally upright position from which it can be lifted by operation of an overhead crane or hoist.

The carriage means may comprise upper and lower carriages disposed one above the other along the track.

The connector means may comprise an upper connector for connecting the upper carriage to an upper end part of the lance and a lower connector for connecting the lower carriage to a part of the lance spaced downwardly from the upper end part of the lance.

The upper connector may provide a pivot connection between the upper carriage and the upper end of the lance and the lower connector may be actuable to allow the lance to swing downwardly about the pivot connection to said upright position.

The lower connector may comprise a hoist actuable to lower the supported lance to the upright position. The hoist may be manually actuable. It may for example, be a manually actuable lever hoist. It may be connected to a hoist line or chain for connection with the lance.

The hoist line or chain may be connected to the lance or passed around it as part of a sling support.

The vessel may include a lance support in the form of a tubular nozzle and the lance may include at its upper end an outer sheath supportable within the nozzle and slidable therein on initial upward and outward movement of the lance to maintain support for the lance until the connection of the lower connector to the lance.

The apparatus may further comprise a solids delivery line connected to the lance exteriorly of the vessel.

The solids delivery line may comprise a separable generally straight section connected to the lance and extending upwardly and outwardly from the side wall of the vessel beneath the track and the lance connector means may be alternatively operable to connect that line section to the carriage means to support that section from the track whereby to enable the delivery line section to be moved upwardly along the track and removed from the apparatus in an initial procedure before extraction of the lance.

The connector means may be operable in the initial procedure to allow the delivery line section to be lowered to an upright position to which it can be lifted on the overhead crane or hoist.

The invention also extends to a method of extracting from a metallurgical vessel a solids injection lance which in its operative position extends through a side wall of the vessel with downwards and inward inclination for delivery of solids material into the vessel, said method comprising:

locating an elongate track so as to extend upwardly and outwardly of the vessel;

mounting carriage means on the track so as to be moveable along the track;

connecting the lance to the carriage means so as to be supported from the track; and moving the carriage means upwardly along the track so as to extract the lance from the vessel while supported from the track.

The track may be located adjacent and parallel with the direction of inclination of the lance. It may, for example, be located above the direction of inclination of the lance.

The method may further comprise the step of lowering the lance to a generally upright position while supported from the track through connection to the carriage means, connecting the upper end of the lance to an overhead crane or hoist, disconnecting the lance from the carriage means and lifting the lance in an upright condition away from the vessel.

The invention further extends to a method of removing from a metallurgical vessel, a solids injection lance and a solids supply line section separably connectable to that lance, the lance having an operative position in which it extends through a side wall of the vessel for delivery of solids material into a lower part of the vessel with the supply line section extending upwardly and outwardly exteriorly of the vessel in alignment with the lance, said method comprising the steps of:

locating an elongate track so as to extend upwardly and outwardly of the vessel above said supply line section;

mounting carriage means on the track so as to be moveable along the track;

connecting the supply line section to the carriage means so as to be supported from the track;

lowering the supply line section to an upright position while supported from the track;

connecting the supply line section to an overhead crane or hoist;

disconnecting the line section from the carriage means and lifting it away from the vessel on the overhead crane or hoist;

connecting the lance to the carriage means;

moving the carriage means upwardly along the track to extract the lance from the vessel;

lowering the lance to an upright position whilst supported from the track;

connecting the lance to an overhead crane or hoist; and disconnecting the lance from the carriage means and lifting it away from the vessel on the overhead crane or hoist.

The method may further comprise the step of moving the carriage means along the track to move the supply line section upwardly and outwardly prior to lowering it to the upright position.

BRIEF DESCRIPTION OF THE DRAWINGS

In order that the invention may be more fully explained, some specific embodiments will be described with reference to the accompanying drawings in which.

DETAILED DESCRIPTION OF THE PREFERRED EMBODIMENT

Figure 1:
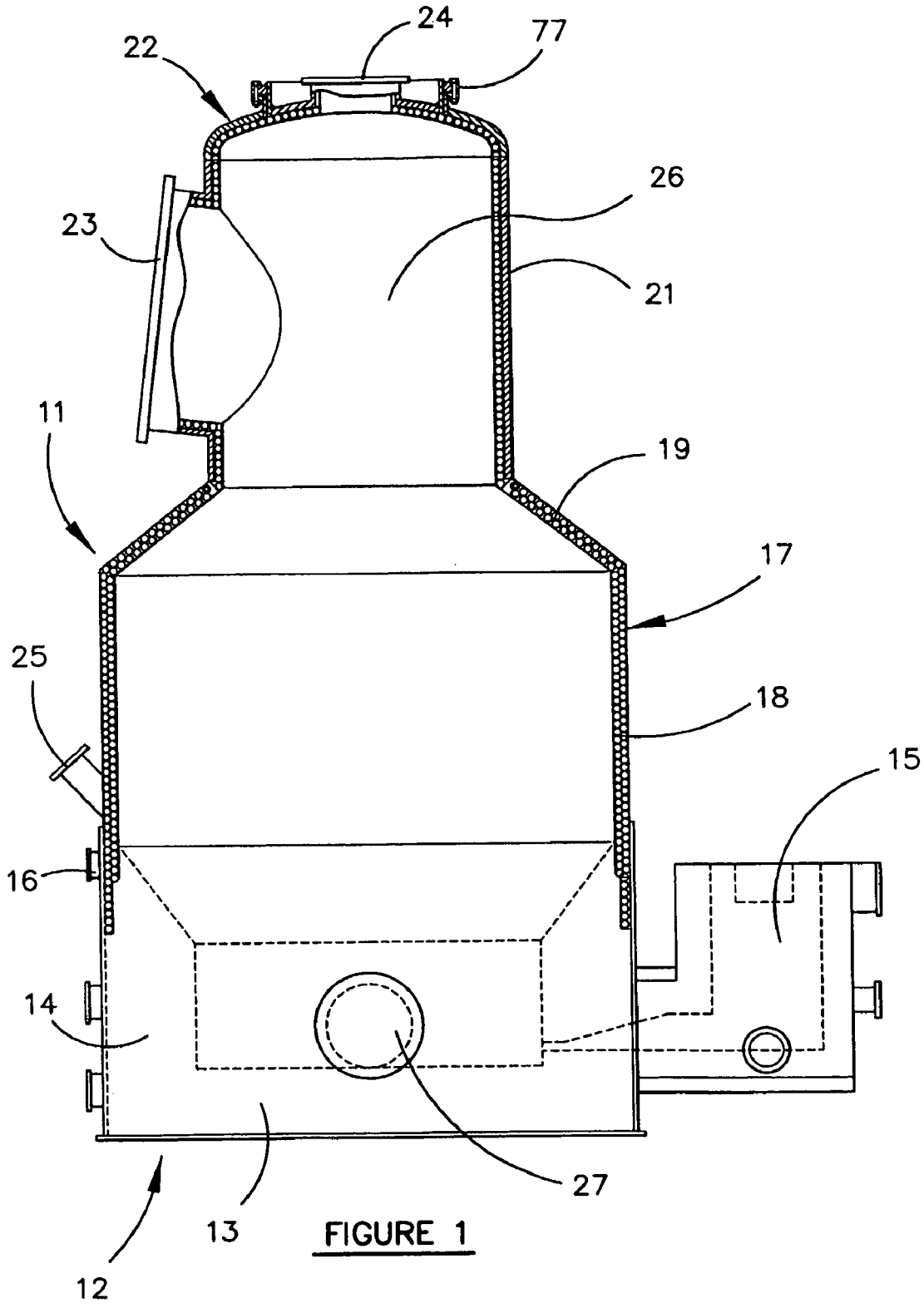
FIG. 1 is a vertical cross-section through a direct smelting vessel.

The drawings show direct smelting apparatus suitable for operation of the HIsmelt process as described in U.S. Pat. No. 6,267,799 and International Patent Publication WO 96/31627. The apparatus includes a metallurgical vessel denoted generally as 11, a hearth 12 which includes a base 13 and sides 14 formed of refractory bricks, a forehearth 15 for discharging molten metal continuously and a tap hole 16 for discharging molten slag.

The base of the vessel is fixed to the bottom end of an outer vessel shell 17 made of steel and comprising a cylindrical main barrel section 18, an upwardly and inwardly tapering roof section 19, and an upper cylindrical section 21 and top section 22 defining an offgas chamber 26. Upper cylindrical section 21 is provided with a large diameter outlet 23 for offgases and the top section 22 has an opening 24 in which to mount a downwardly extending gas injection lance for delivering a hot air blast into the upper region of the vessel. The hot gas injection lance 20 is internally water cooled, being provided with inner and outer annular coolant flow passages for inward and outward flow of cooling water. More particularly, this lance may be of the general construction disclosed in U.S. Pat. No. 6,440,356.

The main cylindrical section 18 of the shell has eight circumferentially spaced tubular mountings or nozzles 25 through which to extend solids injection lances 31 for injecting iron ore, carbonaceous material, and fluxes into the bottom part of the vessel. The solids injection lances are also internally water cooled, being provided with inner and outer annular coolant flow passages for inward and return flows of cooling water. More particularly, the solids injection lances may be of the general construction disclosed in U.S. Pat. No. 6,398,842.

In use the vessel contains a molten bath of iron and slag and the upper part of the vessel must contain hot gases under pressure and extremely high temperatures of the order of 1200° C. The vessel is therefore required to operate as a pressure vessel over long periods and it must be of robust construction and completely sealed.

In a typical installation the main barrel section 18 may be of the order 10 meters in diameter and the upper cylindrical section 21 may be of the order of 5.5 meters in diameter.

Figure 2:
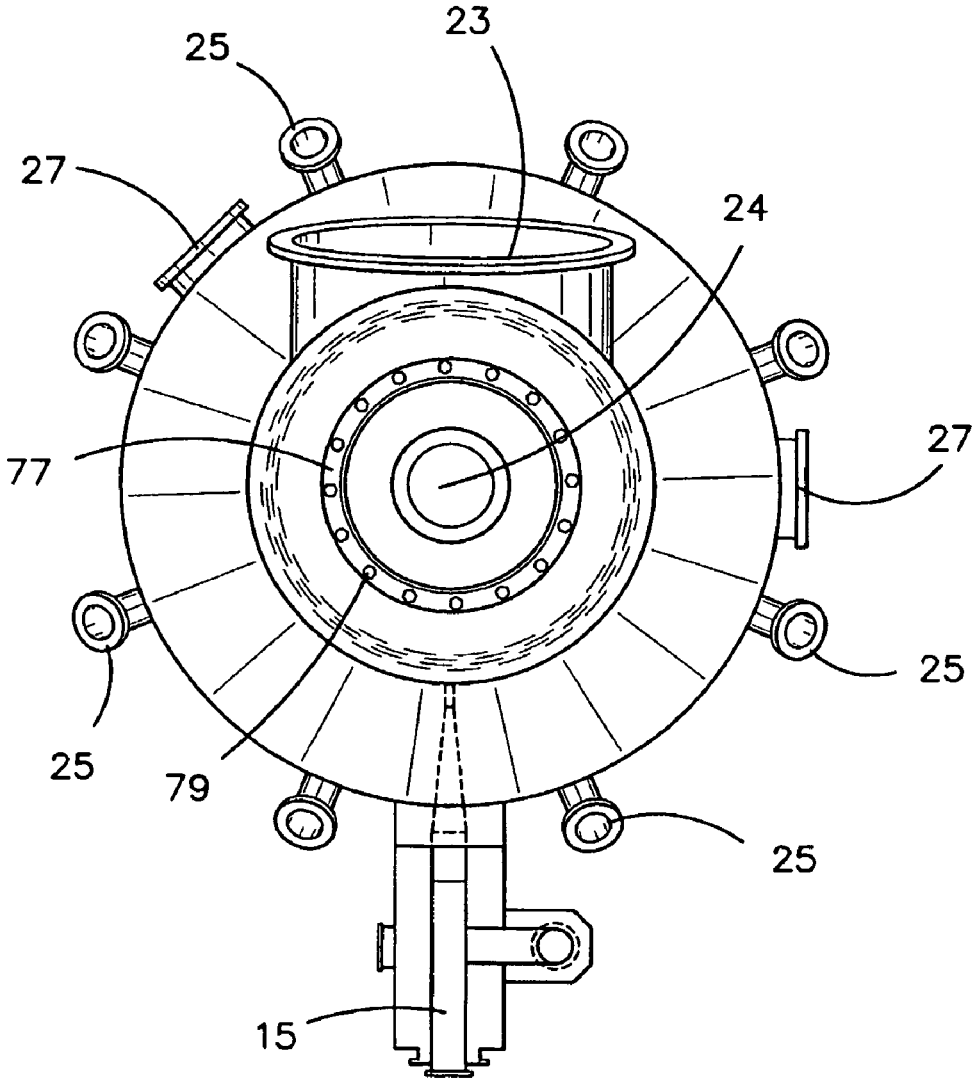
FIG. 2 is a plan view of the vessel.
Figure 3A:
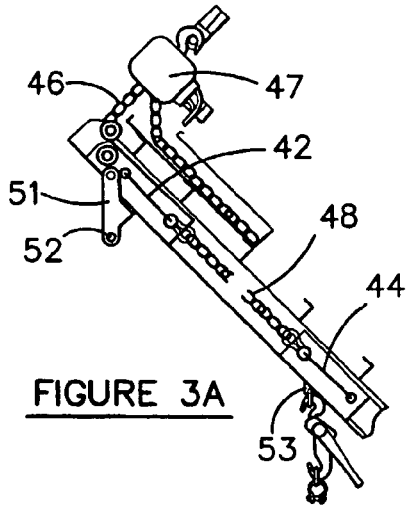
FIG. 3A is an enlargement of part of the lance extraction apparatus.
Figure 3:
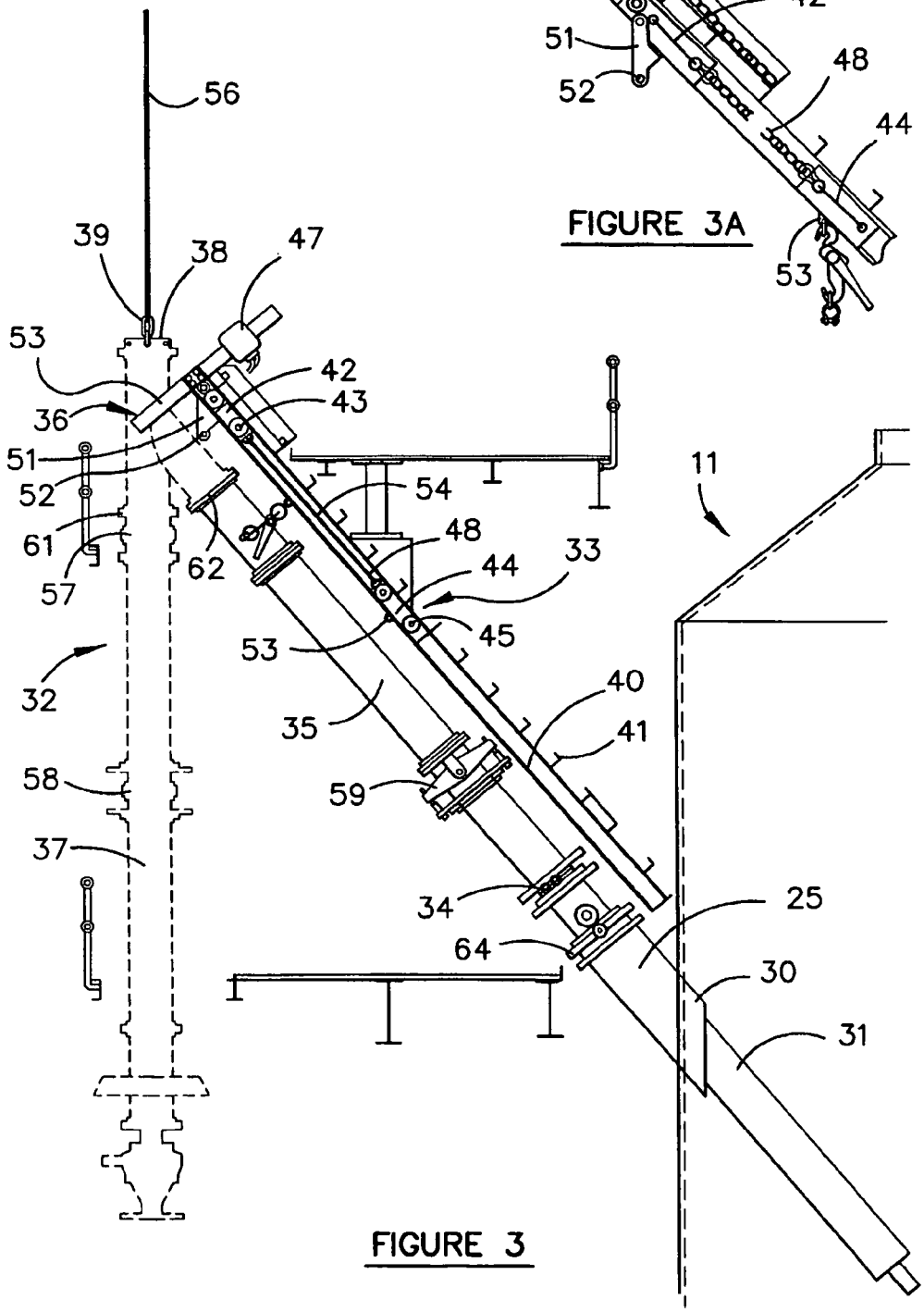
FIG. 3 illustrates a solids injection lance fitted to the vessel together with a solids feed line and a lance extraction apparatus.
Figure 4:
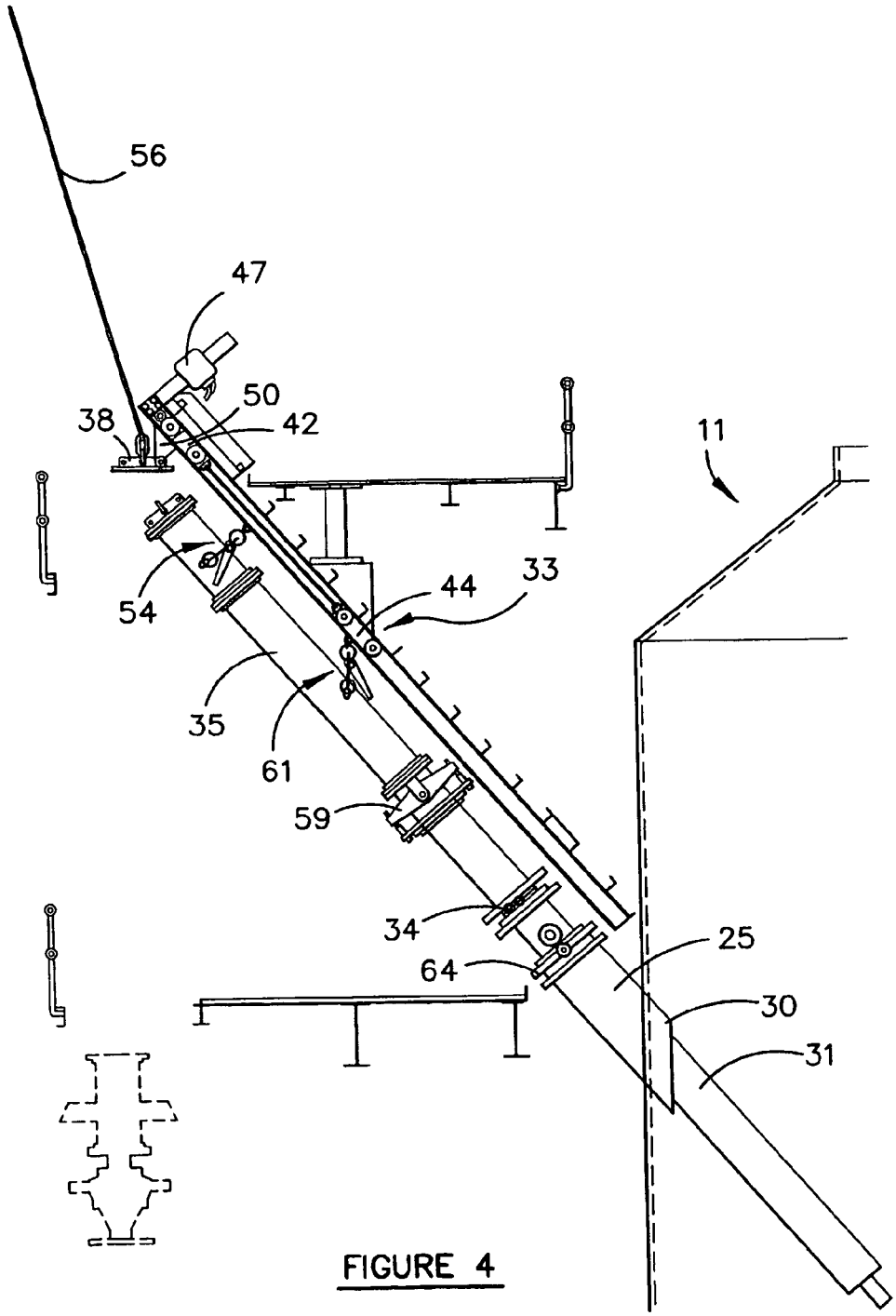
FIGS. 4 to 14 show the manner in which the lance and feed line components can be removed using the extraction apparatus of FIG. 3.
Figure 5:
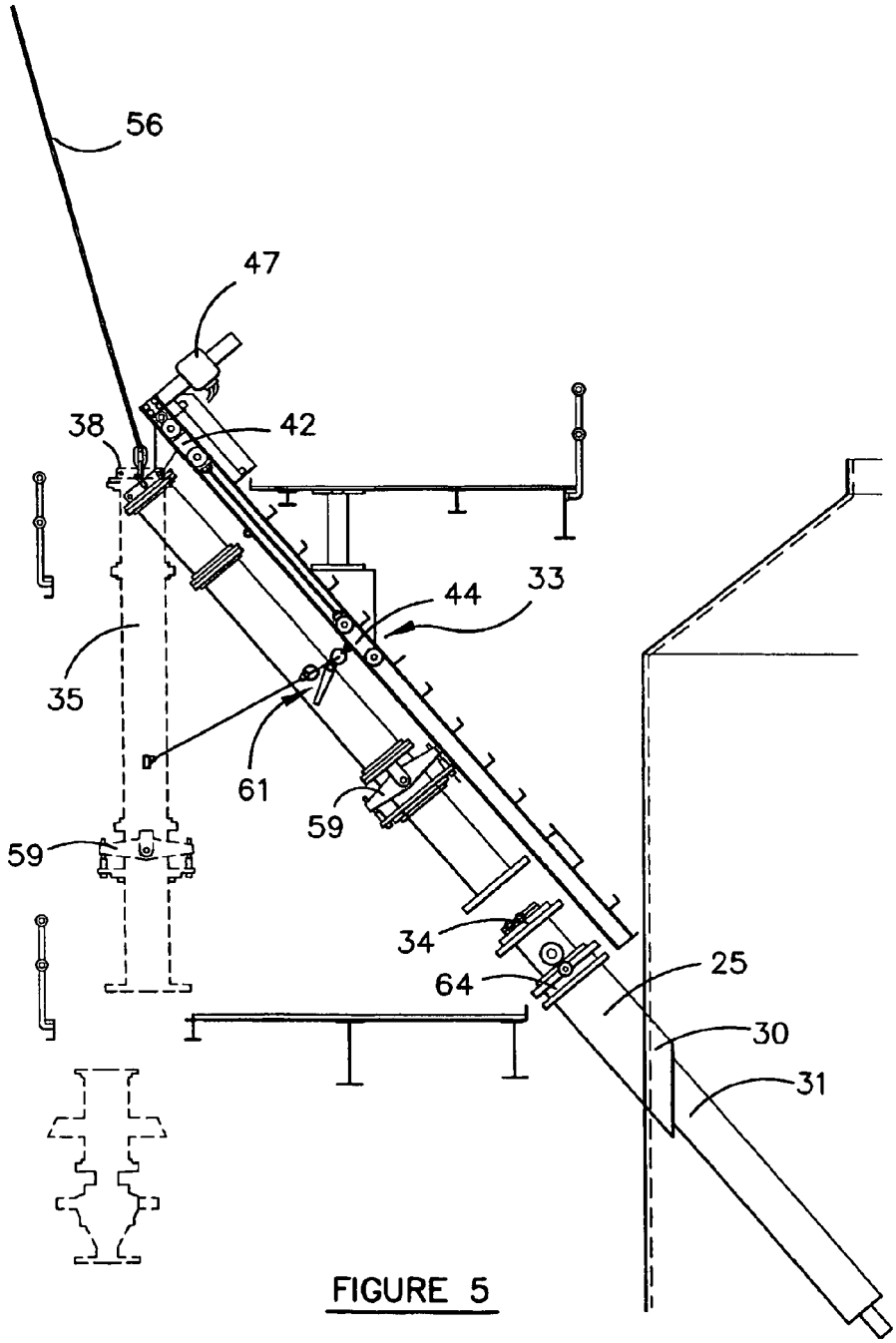
Figure 6:
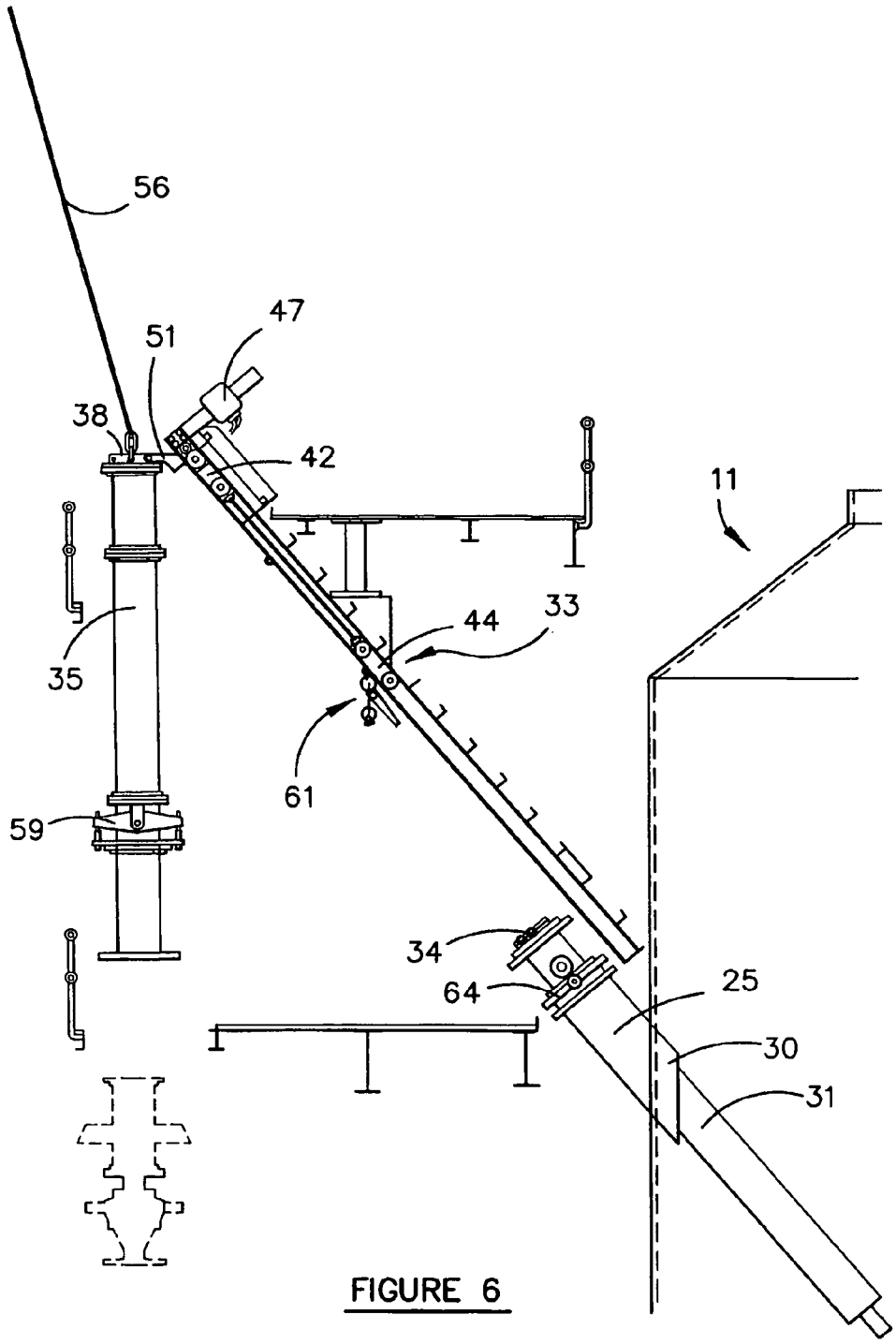
Figure 7:
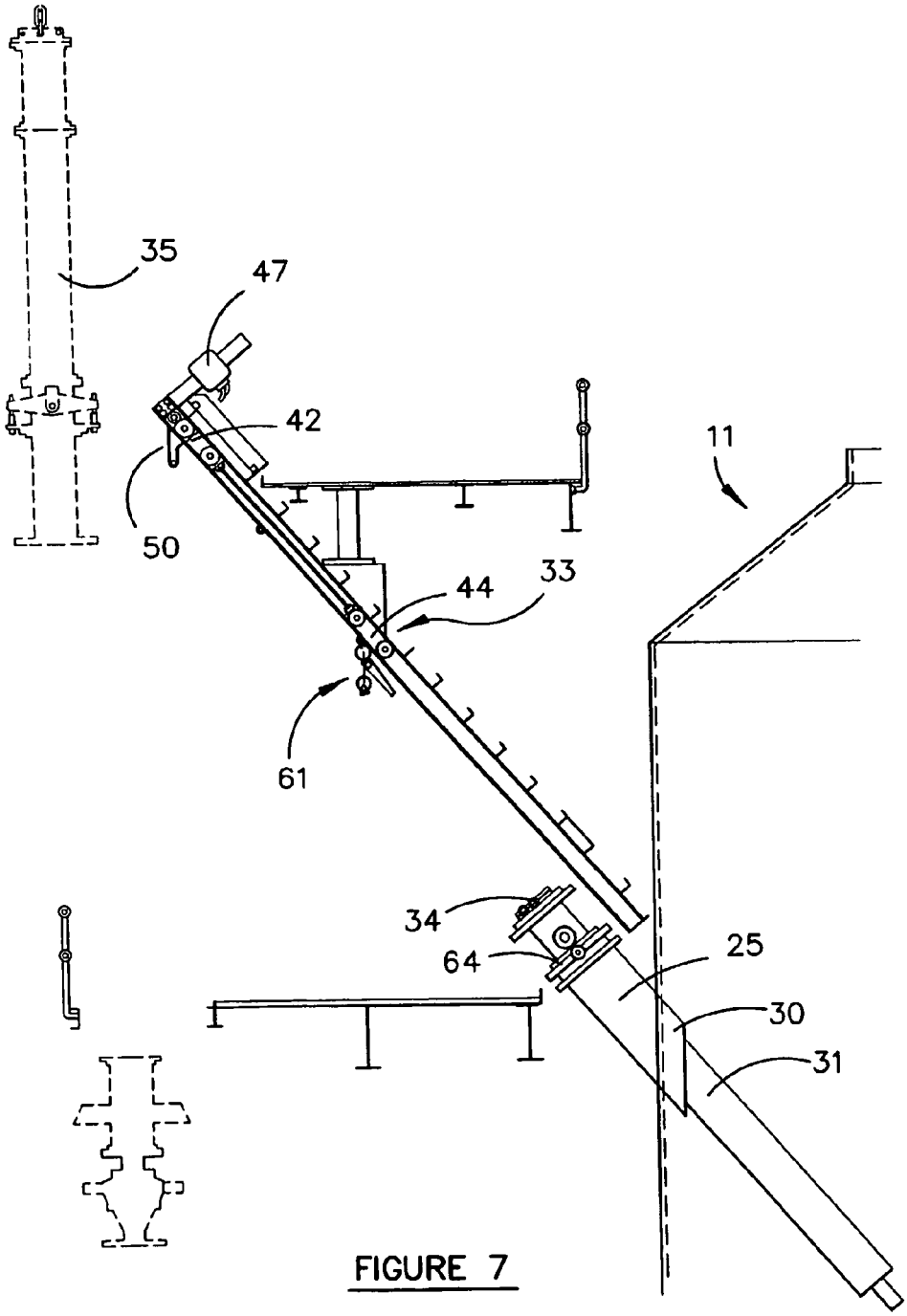
Figure 8:
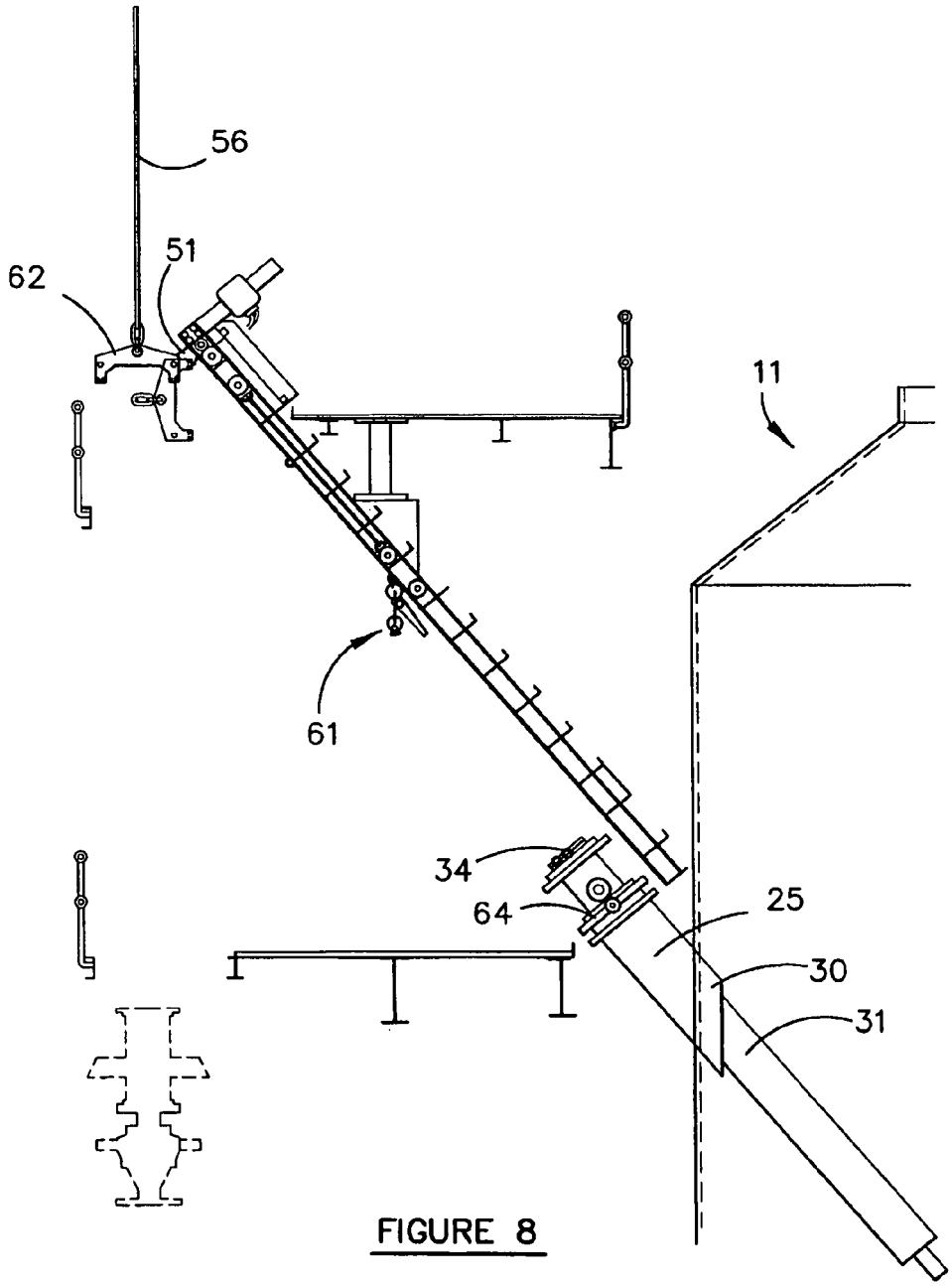
Figure 9:
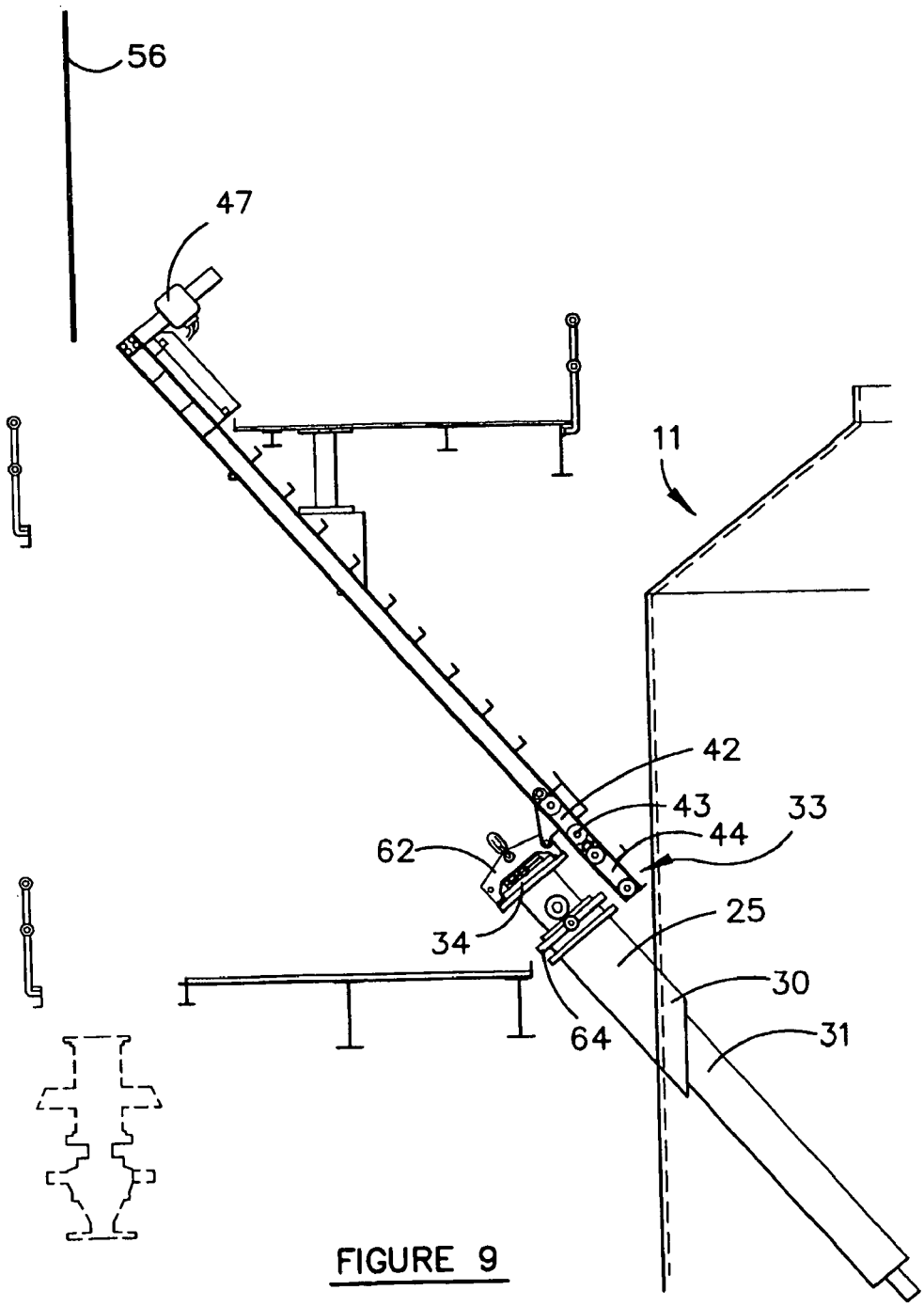
Figure 10:
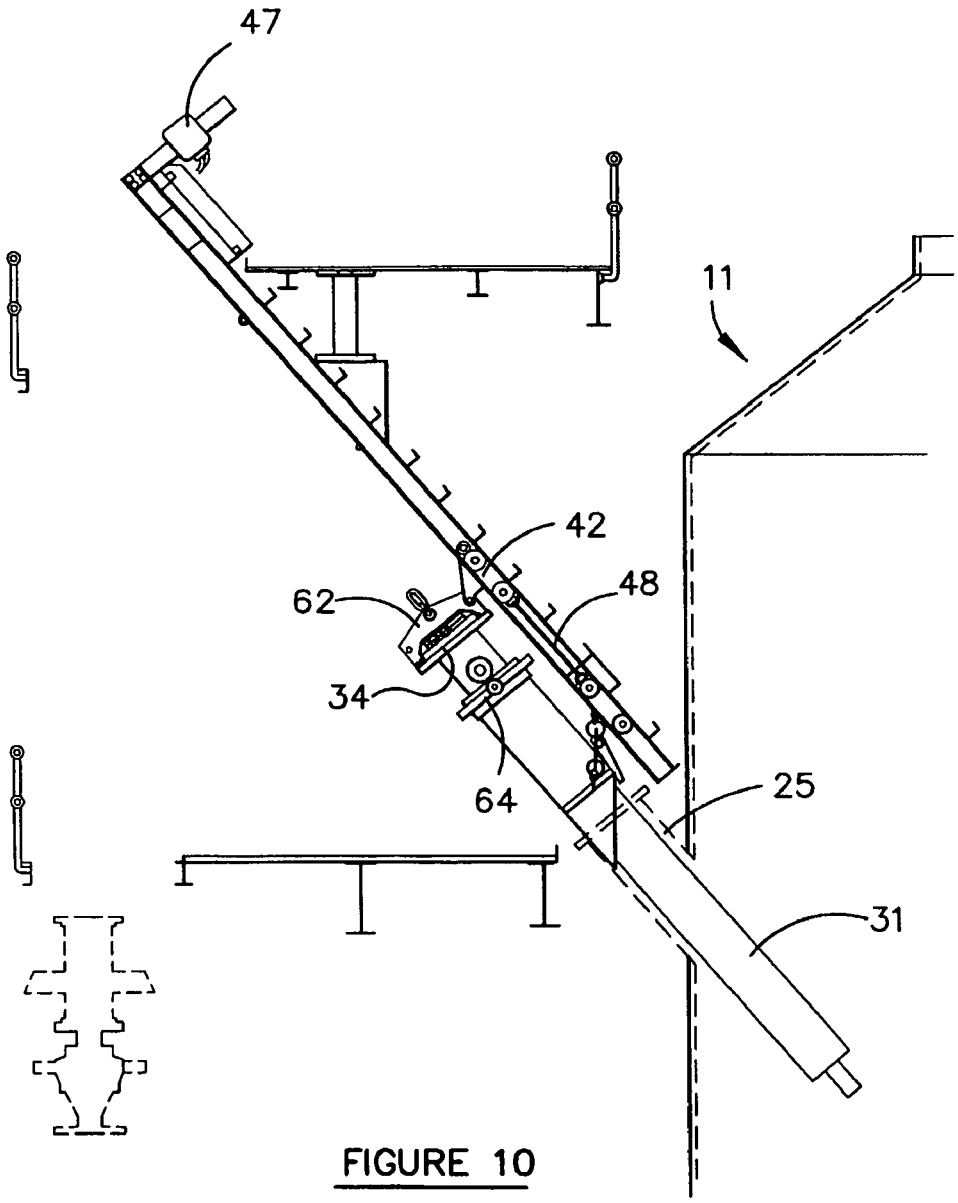
Figure 11:
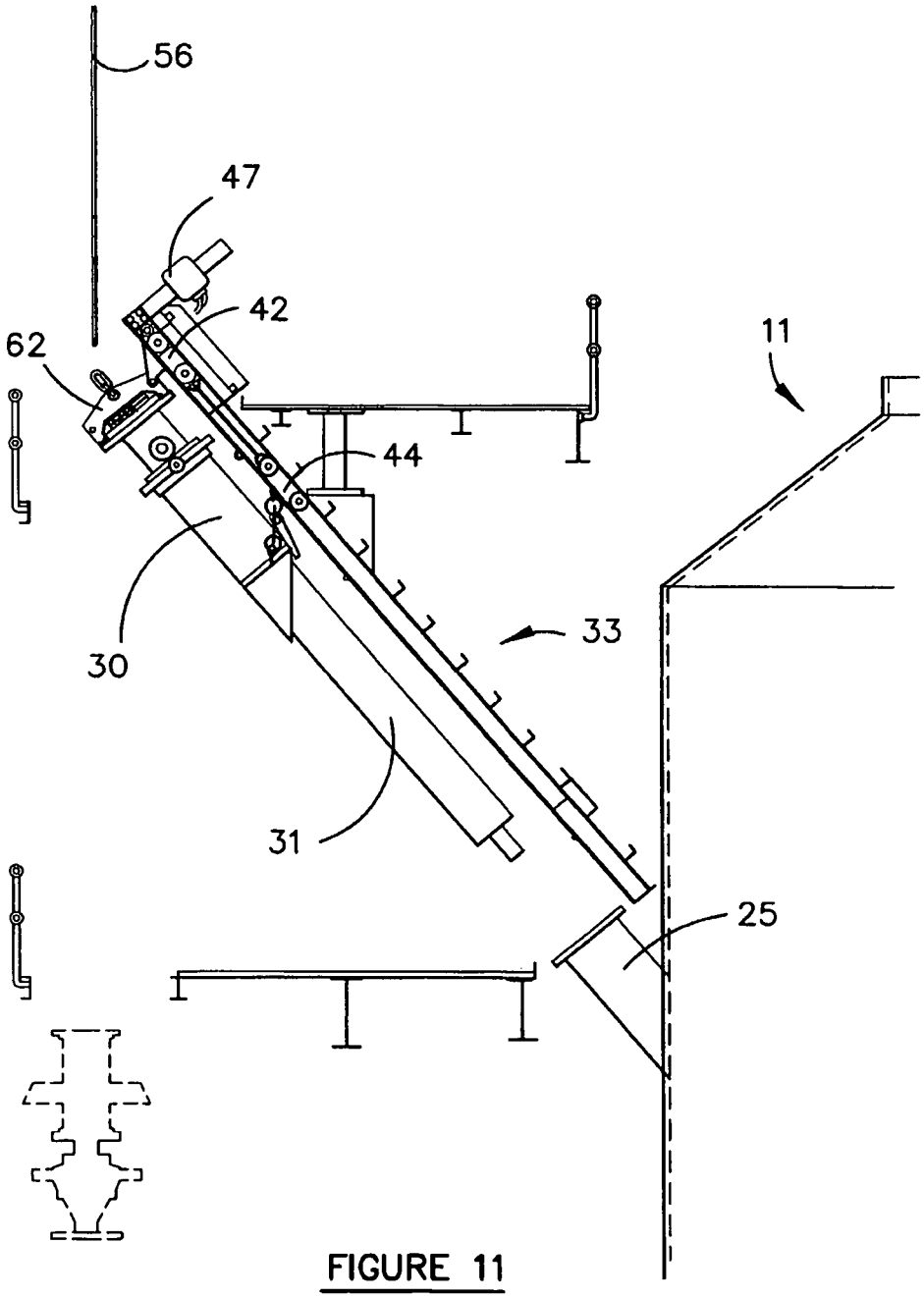
Figure 12:
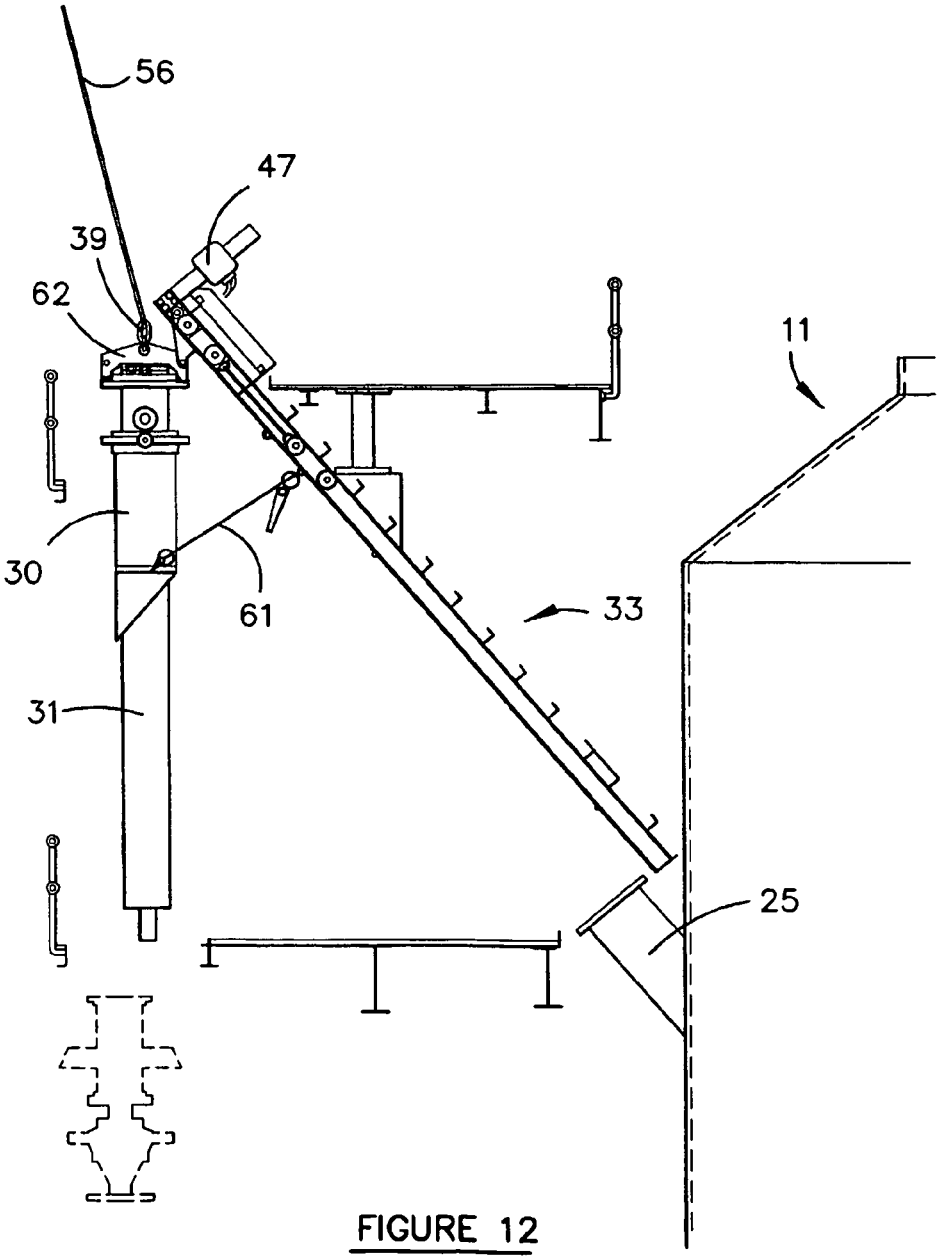
Figure 13:
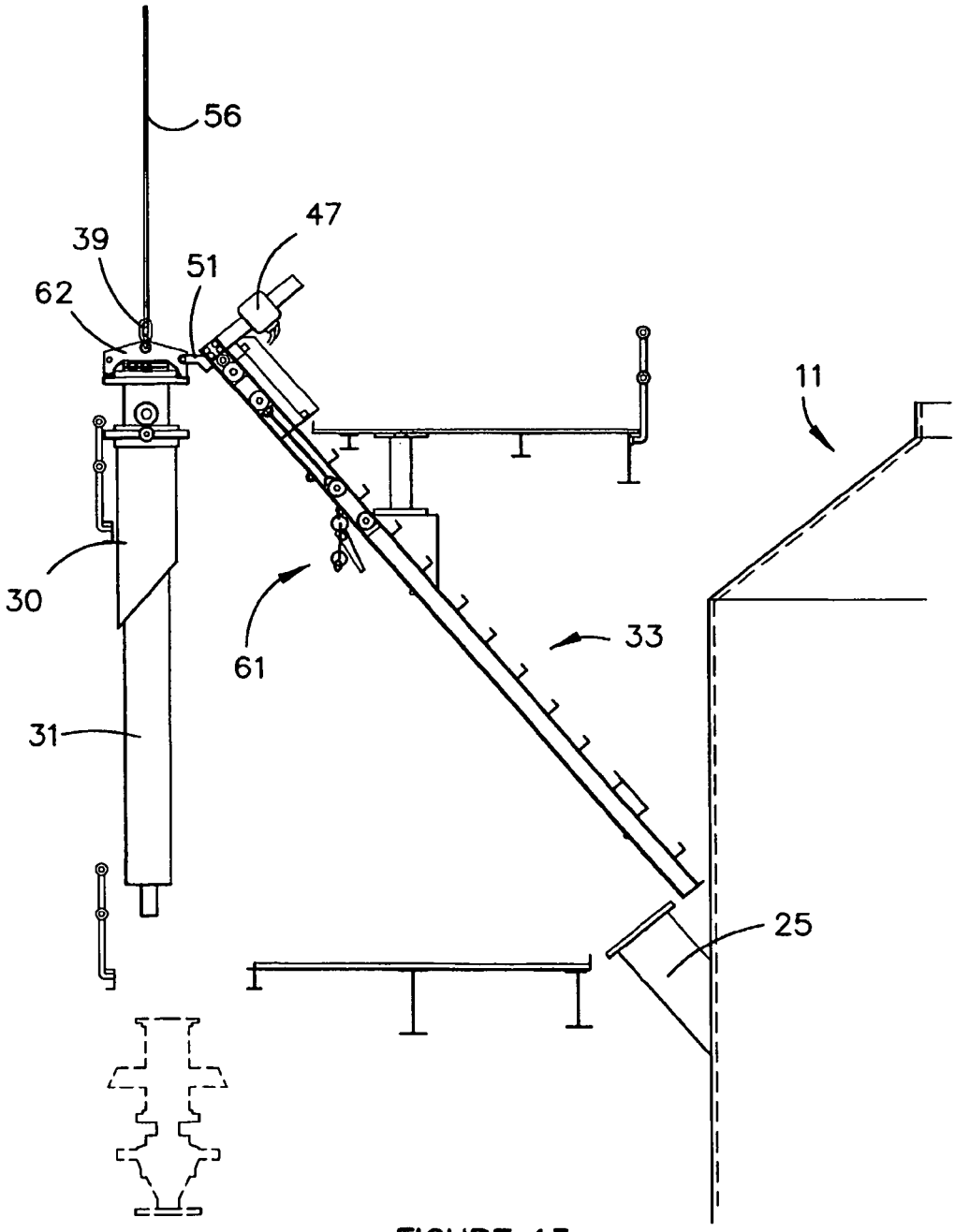
Figure 14:
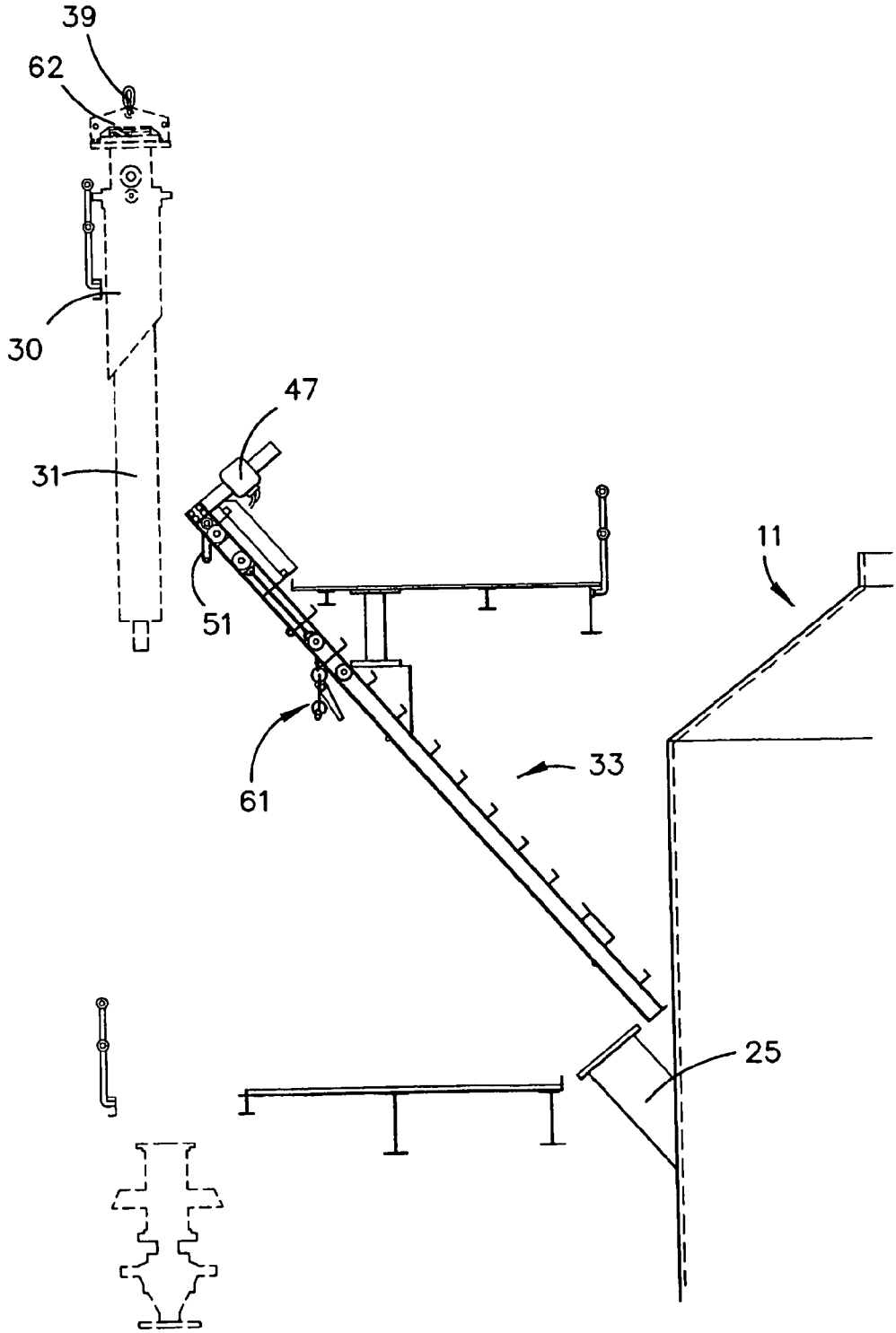

As seen in FIG. 2, vessel 11 is fitted with eight solids injection lances 31 arranged at equal circumferential spacing around the vessel. Four of those lances may inject preheated ore into the bottom part of the vessel and the intermediate four lances may inject coal. Each lance 31 is connected to a respective delivery line for delivering hot ore or coal and there is a dedicated lance extraction apparatus for each lance. FIG. 3 illustrates a hot ore delivery line 32 (a portion of which is represented in outline) and a lance extraction apparatus 33 for one of the lances 31. Similar delivery lines and extraction apparatus may be provided for each of the other lances.

As seen in FIG. 3, the lance 31 is mounted in one of the tubular mountings 25 in the vessel. It has at its upper end an over-size cylindrical sheath 30 which is a sliding fit in the support nozzle 25 and is bolted at 64 to the upper end of nozzle 25. The upper end of the lance is bolted at 34 to the lower end of a straight section 35 of the delivery line 32. The upper end of delivery line section 35 is connected through an elbow connector 36 (shown in outline) to a vertical straight section 37 (shown in outline) of delivery line 32. During smelting operations, hot iron ore is delivered upwardly, typically by pneumatic conveying, through the vertical section 37 of delivery line 32 up to the upper part of the elbow connector 36. The ore then passes back down through the inclined straight section 35 of the delivery line 32 and into the injection lance 31.

Lance extraction apparatus 33 comprises an elongate track support structure 41 supporting a twin rail track 40 extending along the support structure 41 so as to be upwardly and outwardly inclined exteriorly of vessel 11. More specifically, track 40 is located above and parallel with the straight delivery line section 35 and the direction of inclination of lance 31. An upper carriage in the form of a trolley 42 fitted with wheels 43 and a lower carriage in the form of a trolley 44 fitted with wheels 45 are mounted on the track 40 so as to be moveable along the track. The upper trolley 42 is connected by a chain 46 to a hoist 47 operable to raise or lower the upper trolley 42 along the track. The lower trolley 44 is connected to the upper trolley by a connecting chain 48 so that it can be raised and lowered along the track in conjunction with the upper trolley. The upper trolley carries a pivot arm 51 with a hole 52 to provide a pivot connection on removal of the ore line and the lance in the manner to be described below. The lower trolley has a downwardly projecting lug 53 for connection to a line and lance connector as will also be described.

In order to extract lance 31 from the vessel 11, it is necessary to firstly remove the inclined straight section 35 of delivery line 32 (along with the upper parts of the ore line 32 shown in outline). The lance extraction apparatus 33 can be employed for removing straight line section 35 as well as for lance extraction in a sequence of steps which will be described with reference to FIGS. 3 to 16.

FIG. 3

1. A guide 53 locating the upper end of the hot ore delivery line is removed.
2. A lever hoist 54 and chain sling 55 are connected between the track support structure 41 and the straight section 35 of the hot ore line to stabilise that sloping section of the hot ore line.
3. The upper parts of the delivery line 32 (shown in outline) are removed by overhead crane.

FIG. 4

4. The lifting bracket 38 is located, via the overhead crane or trolley, in close proximity to upper trolley 42 and is pivotally connected to the downwardly projecting arm 51 on the upper trolley 42.
5. The upper trolley 42 is lowered down the track through a small distance and the lifting bracket is attached to the upper end of the sloping straight section 35 of the ore delivery line 32.
6. The bottom trolley 44 is connected by two lever hoists 61 to a lower section of the sloping line section 35.
7. The lever hoist 54 at the location further up the line section 35 is released and the pivot arm 51, through lifting bracket 38, supports the upper part of the sloping straight section 35.
8. The sloping section 35 of the ore delivery line 32 is disconnected from the upper end of the lance 31 by undoing the flange bolts at 34.

FIG. 5

9. The upper and lower trolleys 42, 44 are pulled to the top of the track by operation of hoist 47.
10. The hot ore line section 35 is lowered to an upright near vertical position by lowering the lever hoists 61 to allow the line section to swing about the pivot connection between the lifting bracket 38 and the pivot arm 51 on the upper trolley 42.

FIG. 6

11. The lever hoists 61 are disconnected from the hot ore line.
12. The line section 35 is lifted on the main crane or hoist until the pivot arm 51 is horizontal and the hot ore line section is hanging vertically under the main crane.

FIG. 7

13. The pivot link of the upper trolley is disconnected from the lifting bracket and the line section 35 is lifted vertically away to a remote location.

FIG. 8

14. A lance lift bracket 62 is brought in with the main crane and connected to the top trolley pivot arm 51.

FIG. 9

15. Both the lower trolley and the upper trolley are lowered until the lower trolley reaches the lower end of track 41 adjacent nozzle 25.
16. The upper trolley 42 is lowered to the bottom of the track, adjacent the lower trolley, to allow lance lift bracket 62 to be connected to the flange 34 at the upper end of the lance.
18. The lance is unbolted at 64 from the mounting 25 and the lance released by using fluid pressure units to release the lance.

FIG. 10

19. The upper trolley is drawn up the track by operation of hoist 47.
20. The lower trolley is connected to a lower part of the sheath 30 of the lance by means of the two lever hoists 61. During the initial upwards movement and partial withdrawal of the lance, the sheath 30 slides in the support nozzle 25 to maintain support of the lance until the lower hoists are connected to complete support of the lance from the carriages. The connection point for hoist 61 is located at a point intermediate sheath 30 so that the lower carriage can support the lance before sheath 30 comes out of supporting engagement with nozzle 25. The lower end of the sheath 30 is angled so as to be generally vertical in order to be substantially flush with the internal surface of the vessel when the lance is installed within the vessel. This vertical section provides the sheath with an extended lower part which enhances the extent of engagement of the sheath with the nozzle as the lance is extracted from the vessel via the nozzle.

FIG. 11

26. The two trolleys are raised to the upper end of the track by operation of hoist 47. This locates the lance at the upper end of the track, with the tip of the lance clear of the external periphery of nozzle 25.

FIG. 12

27. The lance 31 is lowered about the pivot connection of arm 51 by gradually releasing the two lever hoists 61 until the lance is near vertical and the main crane is reconnected to the lance lift bracket 62.

FIG. 13

28. The two lever hoists 61 are released and withdrawn. The main crane is operated to lift the lance until the pivot link 51 on the upper carriage is horizontal and the lance is hanging vertically under the crane.

FIG. 14

29. The lance lifting bracket 62 is disconnected from pivot arm 51 and the lance is then is lifted vertically away and removed to a remote location.

It will be appreciated that the lance and the delivery line sections and elbow connector can be installed or reinstalled by a reverse sequence of steps, the hoists 61 being operated to swing the lance or line section upwardly into its inclined position while being supported from the track through the connections to the upper and lower trolleys.

Figure 15:
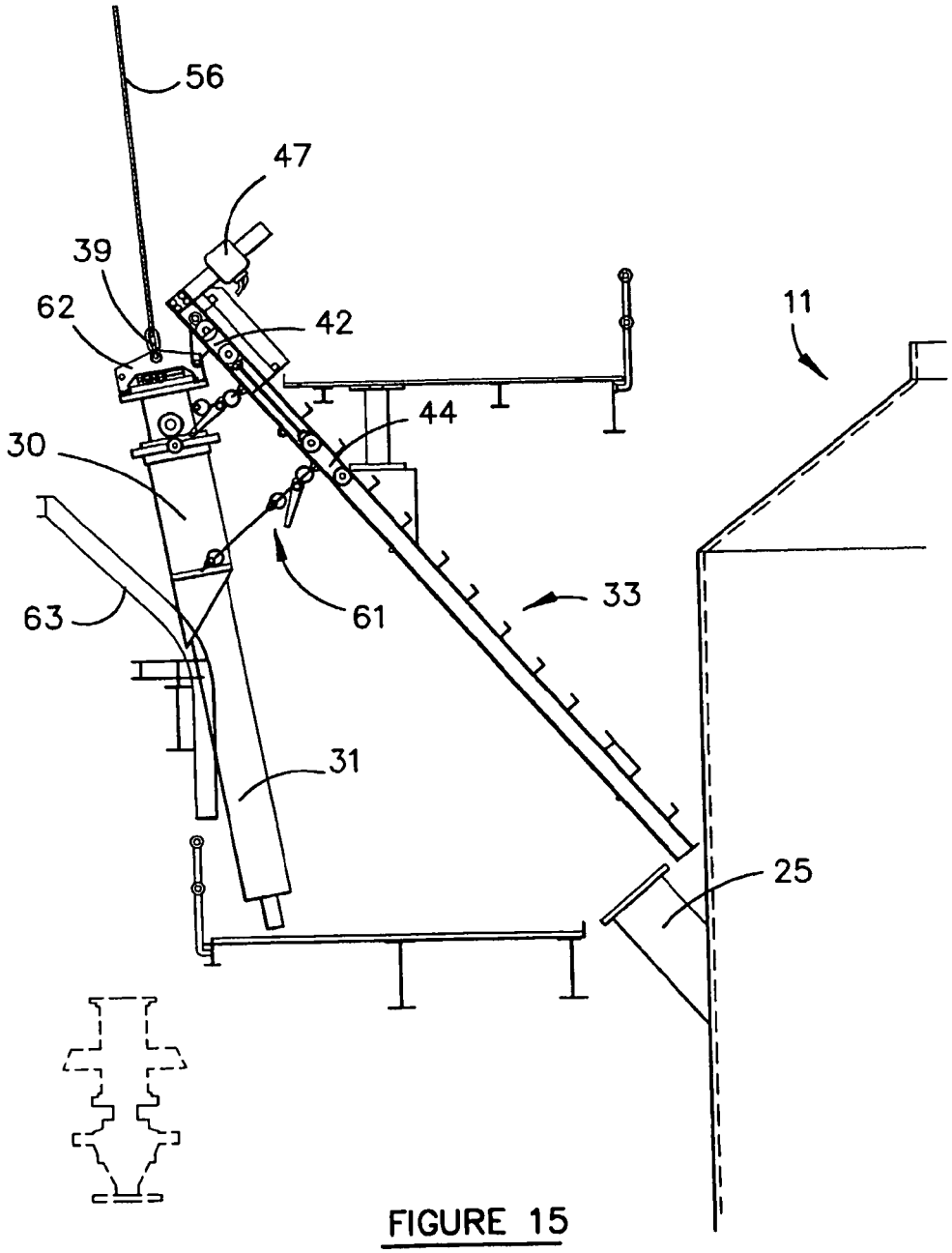
FIGS. 15 to 17 illustrate a modification to the apparatus and procedure illustrated by FIGS. 3 to 16.
Figure 16:
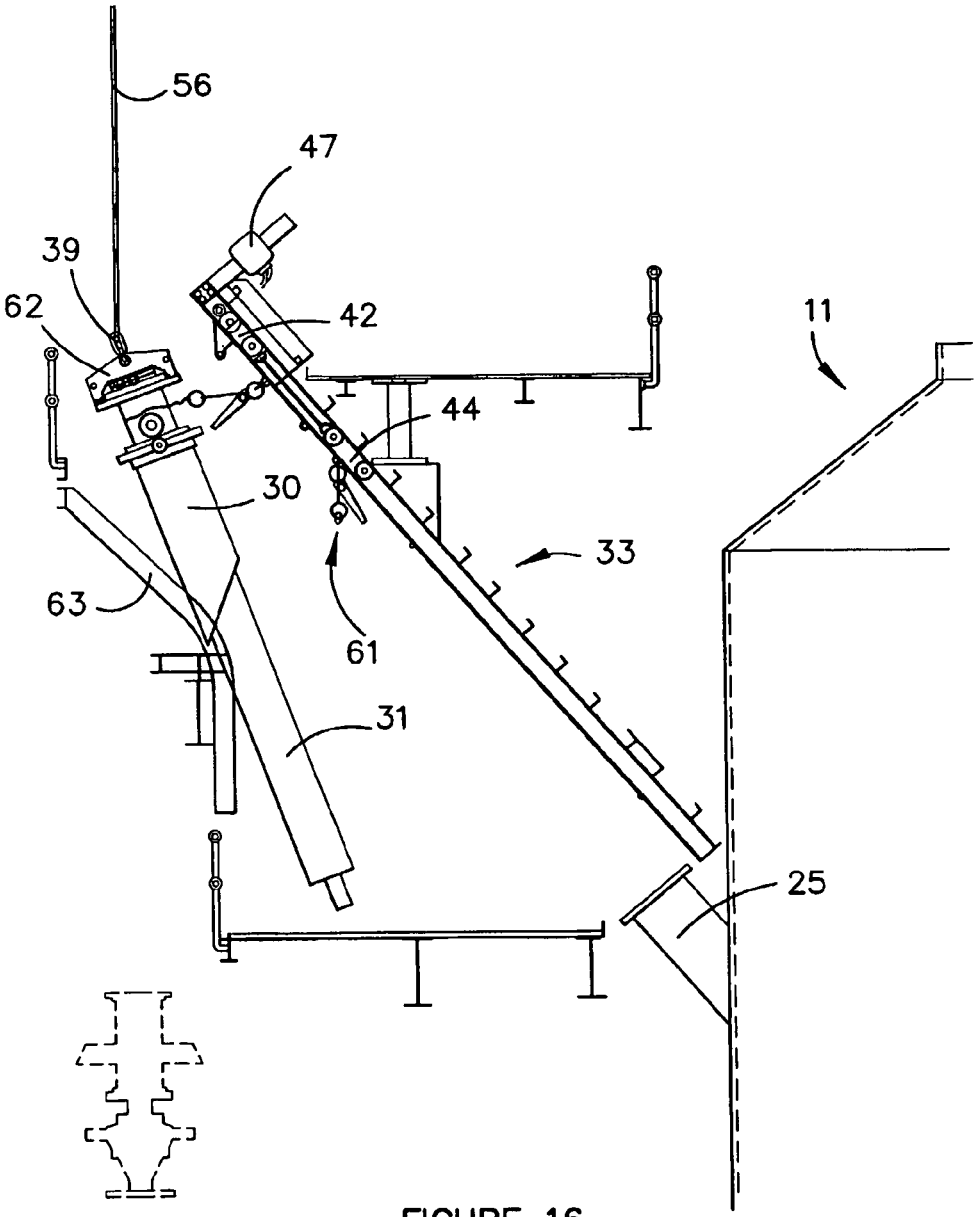
Figure 17:
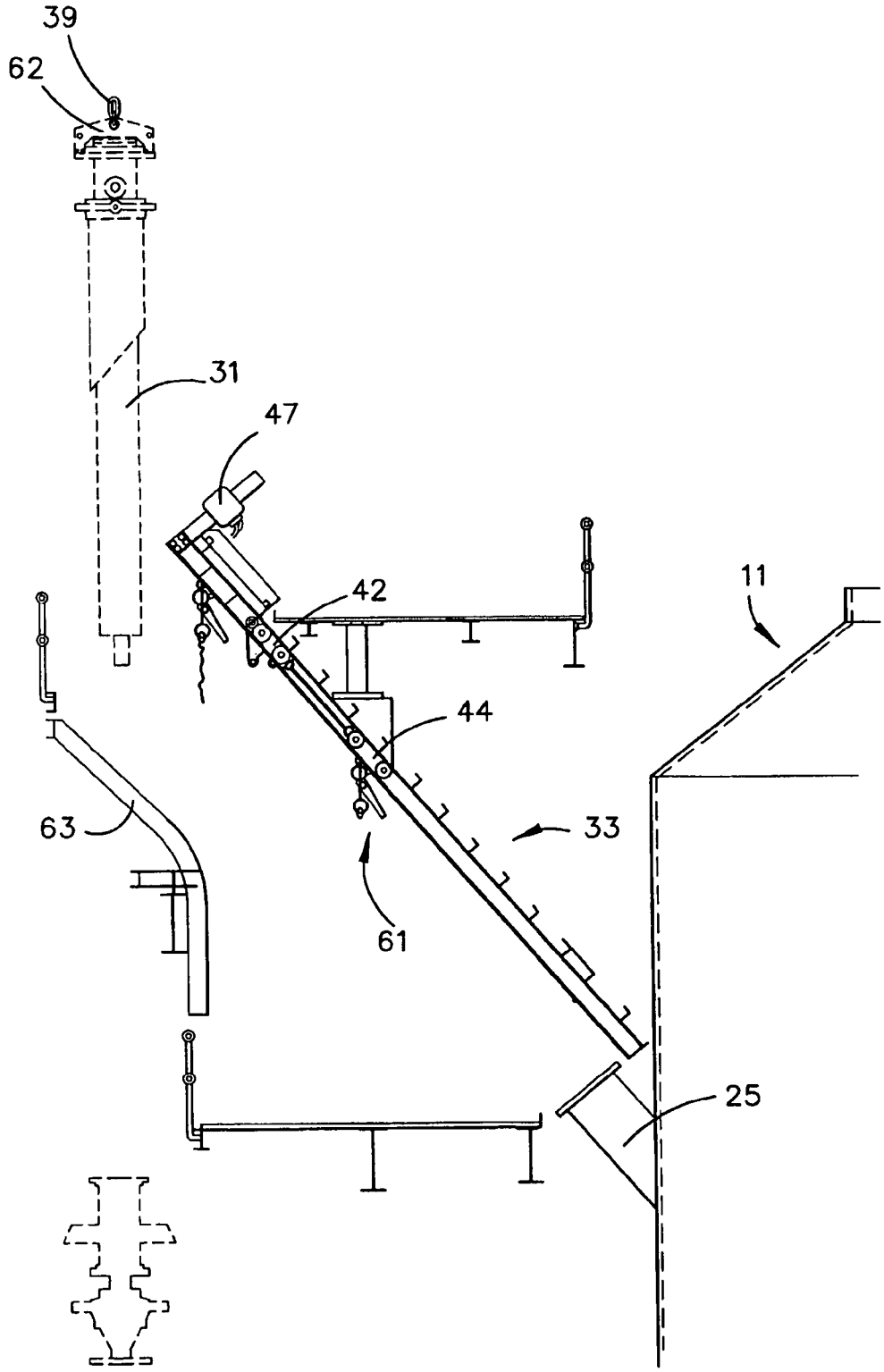
Figure 18:
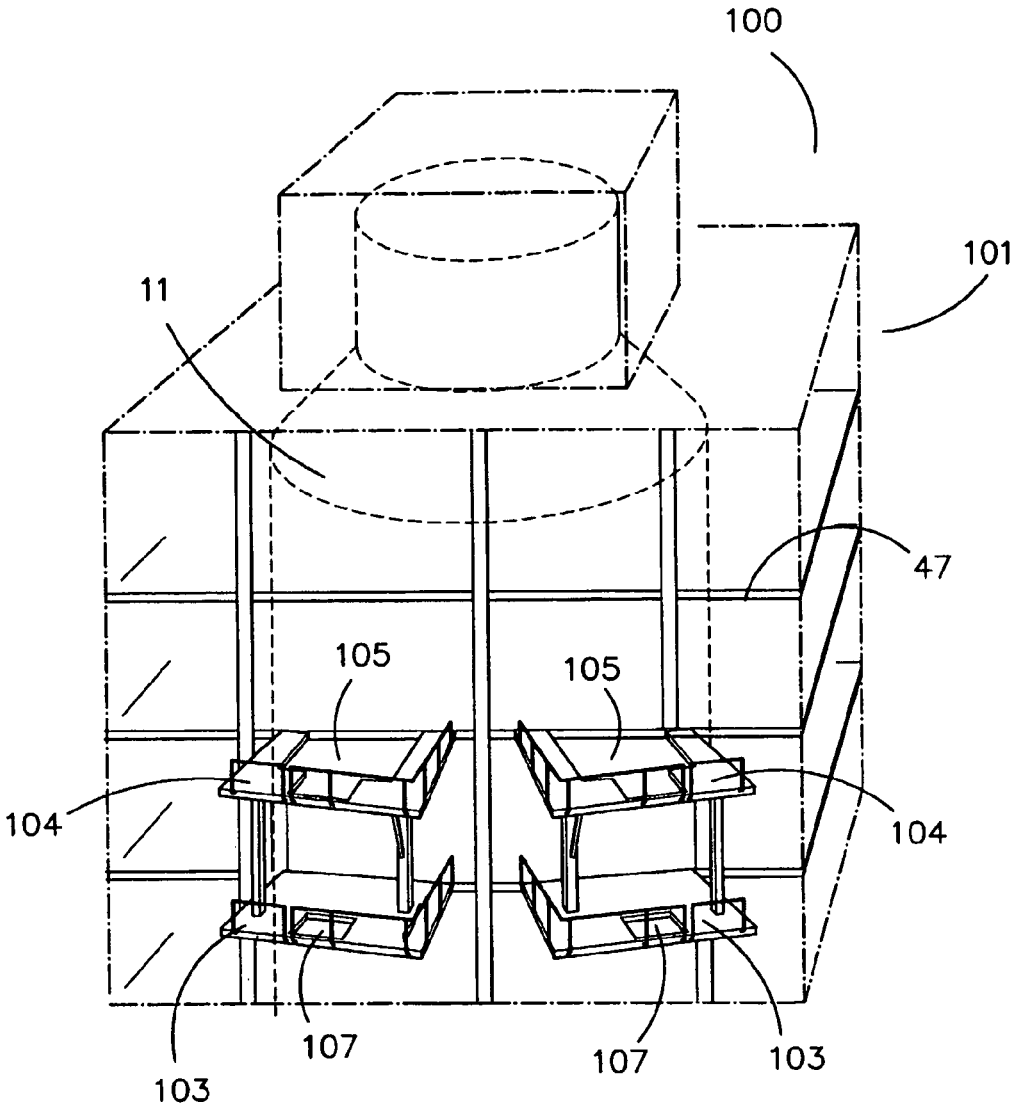
FIG. 18 is a perspective view of the access tower that surrounds the vessel.

Each of the lances 31 and the hot ore or coal delivery line sections can be removed by the respective extraction apparatus in a sequence of operations as described above and installed or reinstalled by a reverse sequence of operations. Depending on the positioning of surrounding ancillary equipment, it may not be possible in all cases to lower each lance and delivery line section to a fully vertical position before it is lifted away on the main crane. FIGS. 15 to 17 illustrate a modification in which a lance 31 is lowered into engagement with a guide 63 which engages the lower end of the lance to hold it in an upright but slightly inclined condition, the guide subsequently guiding and supporting the lower end of the lance to gradually bring it to a vertical position as it is drawn upwardly on the crane until it clears the surrounding structure and can be lifted vertically away. It may be necessary to provide such variations for some of the lances around the vessel depending on accessibility and the proximity of surrounding equipment. In circumstances where the smelting vessel is generally clear of surrounding obstructions it may be possible to mount a single track support for movement around the vessel, for example by being suspended from an overhead circular rail, so to enable the one extraction device to be used sequentially at different locations about the vessel to service several or all of the lances.

FIGS. 18 to 21 show an access tower 100 that surrounds the vessel 11. The access tower 100 locates and supports ancillary equipment that services the vessel 11, such as platforms that provide personnel with access to the vessel 11, cooling pipes for the vessel cooling system and the hoists for installing and removing the lances and raw materials delivery system.

Figure 19:
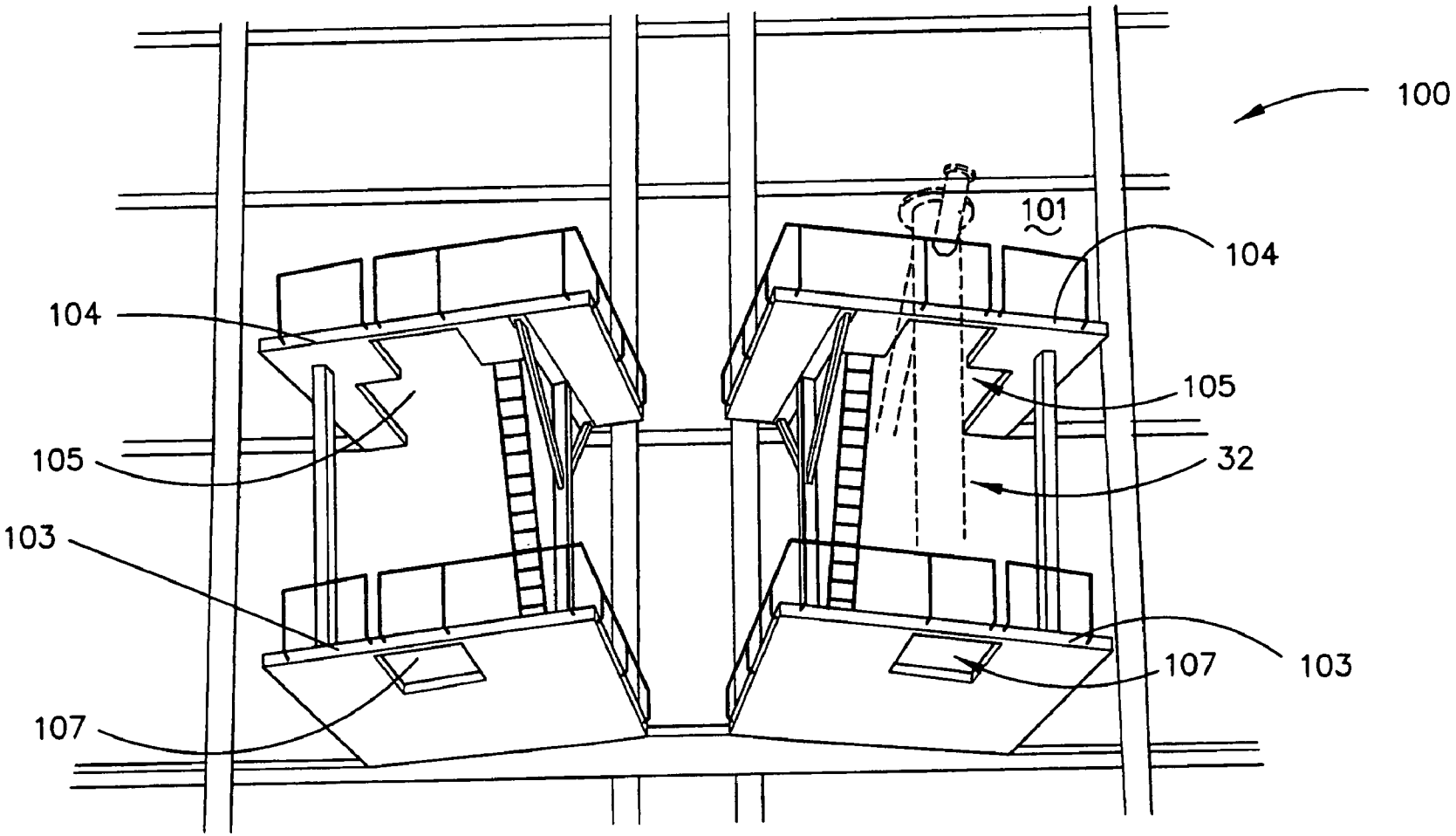
FIG. 19 is a perspective view from the level of lower extraction platforms.
Figure 20:
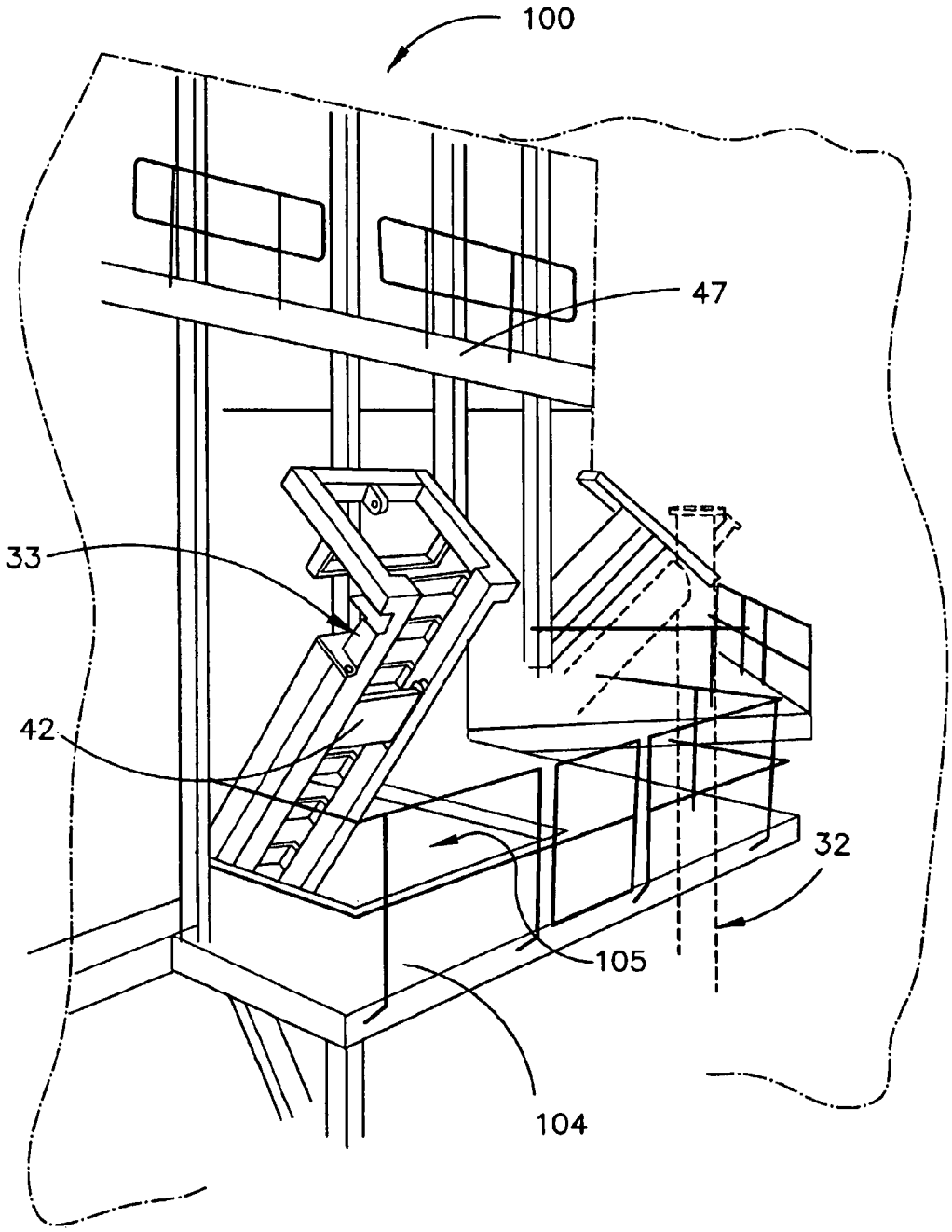
FIG. 20 is a side perspective view of an upper extraction platform.
Figure 21:
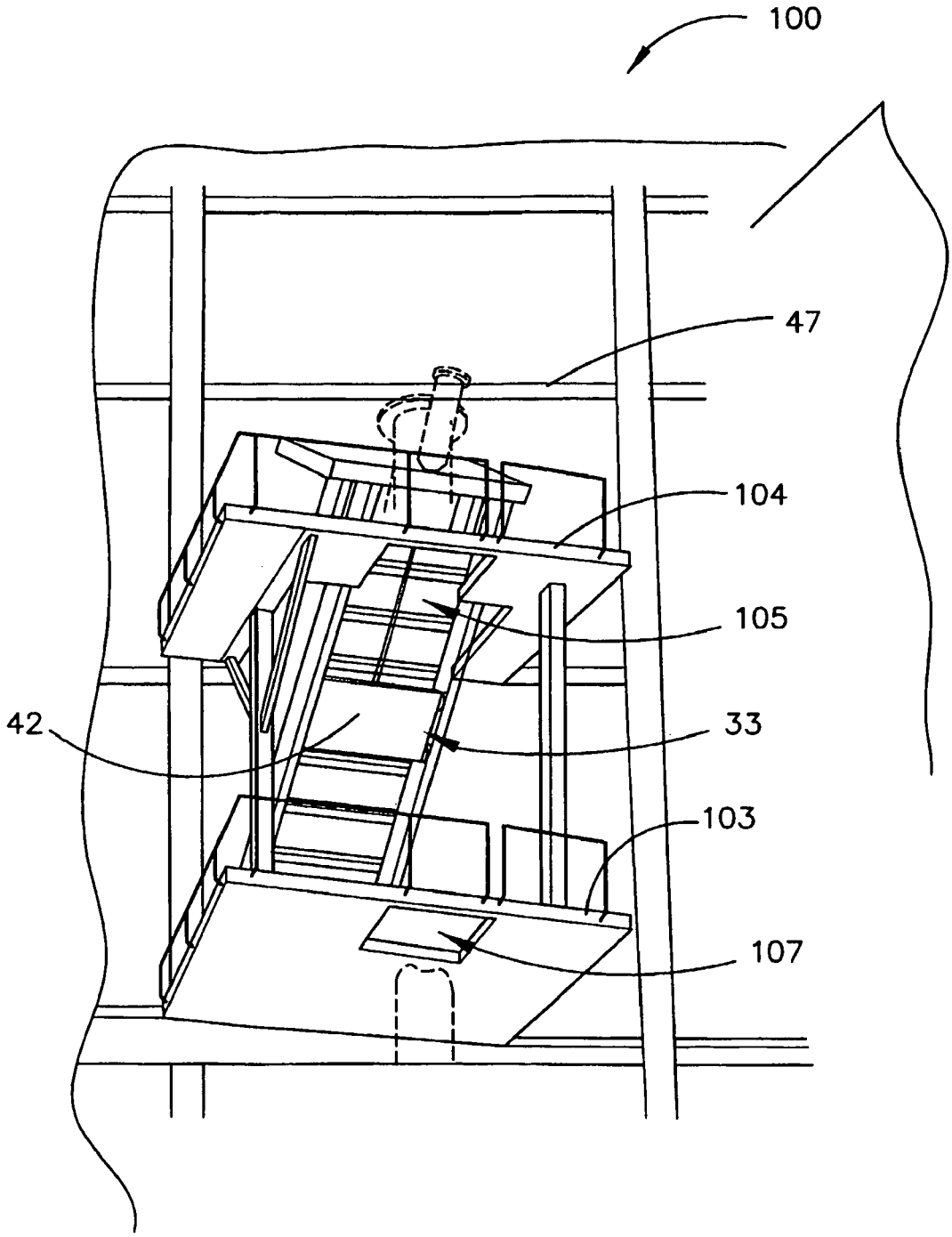
FIG. 21 is a perspective view from below the upper extraction platform.

A pair of platforms 103,104 are provided for each lance 31. As best seen in FIG. 19, a first platform 103 is located on the tower at a level adjacent the nozzles 25 that locate the lances within the vessel. A second platform 104 is located above the first platform 103. A first end of the hoist is positioned adjacent to the vessel above the nozzles that receive and located the lances 31 onto the vessel. As shown in FIG. 20 a second end of the hoist 47 is located upwardly and outwardly from the vessel, above the second platform 104 at a working height suitable for personnel to access this second end. This may require a portion of the hoist to be located within a recess, or alternately an aperture 105, of the second platform 104.

The second platform 104 is typically located part way up the vessel and access tower. Typically, an upper portion of the vessel and an upper portion of the access tower 101 extends above the level of the second platform. The upper portion of the access tower may be set back from the second platform so that substantially clear space is provided vertically above the area of the second platform 104 that extends outwardly beyond the periphery defined by the upper portion 101 to define an extraction envelope. This clear vertical space is to enable substantially unimpeded crane access to the second ends of the hoists and the recesses (or apertures) in the second platform 104 through which the hoists and lances pass. The vertical space may be referred to as an extraction envelope.

In operation, the raw materials feed line may pass vertically through aperture 107 in the first platform 103 and through aperture 105 in the second platform 104 and then extend parallel with the hoist downwardly and inwardly towards nozzles 25 which retain the lances onto the vessel. When removing lances 31, and associated raw material feed lines from the vessel, the lances are extracted along rails as described previously in relation to FIGS. 3-17. An upper portion of the lance will pass through the recess (or aperture) 105 in the second platform 104 that the hoist is retained within or adjacent to. A coupling from an overhead crane or hoist, passes through the extraction envelope that extends above the second platform and is attached to the lifting bracket 62 secured at the rear end of the lance as described in previously in relation to FIGS. 8 and 9. The lance is pivoted about pivot arm 51 into a vertical position. The recess (or aperture) 105 in the second platform 104 is sufficiently shaped to allow the lance to move between a position where it extends through the recess/aperture parallel with the hoist and a position where it is suspended vertically from adjacent the second end of the hoist and ready to be lifted clear of the second platform 104 via an overhead crane or hoist.

The second end of the hoist 47 is located a sufficient height above the first platform for the tip of the lance 31 to clear the first platform and the nozzle 25 as it moves between its vertical position and it position parallel with the hoist. The lance tip is preferably located at a height above the first platform when suspended from pivot arm 51 in its vertical position. This allows personnel to access and inspect the lance from the first and second platforms.

Depending on the length of the lance, there may be insufficient clearance between the first and second platform for the second platform to comprise a floor level of the access tower.

In this instance, the second platform preferably extends outwardly from the first periphery of the access tower and is displaced vertically downwardly from a third platform located on a floor level. The third platform located at a predetermined height above the first platform provides sufficient head clearance for personnel on the first platform.

Accordingly, the vessel and access tower provide a smelting apparatus that supports a lance installation apparatus operable to install injection lances into a lower region of the vessel, the access tower comprising one or more lance installation envelopes extending vertically above said installation apparatus.

Additionally the lance installation apparatus may extend laterally from the vessel beyond an external perimeter of an upper portion of the tower, the extraction envelope located adjacent the external periphery of the upper portion of the tower.

Additionally the lance installation apparatus extends upwardly and outwardly from a first end adjacent the vessel to a second end laterally displaced outwardly from the external periphery of the upper portion of the tower.

Other variations may be required and it is to be understood that the illustrated apparatus has been advanced by way of example only and that many variations can be made without departing from the scope of the appended claims.

The invention claimed is:

1. Smelting apparatus comprising:

a metallurgical vessel within which to perform direct smelting to produce molten metal;

at least one elongate solids injection lance extending through a side wall of the vessel with downwards and inwards inclination for injecting solids material into a molten bath contained within the vessel;

a downwardly extending gas injection lance for delivering a hot air blast into upper regions of the vessel;

an elongate track extending upwardly and outwardly from the side wall of the vessel;

a carriage moveable along the track;

a carriage drive configured to move the carriage along the track, the carriage being connectable to the solids injection lance to enable the solids injection lance to be supported from the track and moved upwardly and outwardly by operation of the carriage drive and thereby extracted from the vessel; and a lance connector for connecting the solids injection lance to the carriage so as to be supported through the carriage from the track, the lance connector being operable to allow the connected solids injection lance to be lowered from an initial inclined position extending parallel with the track to a generally upright position from which the solids injection lance is able to be lifted by operation of an overhead crane or hoist.

2. Smelting apparatus as claimed in claim 1, wherein the track is disposed adjacent and parallel with the direction of inclination of the solids injection lance.

3. Smelting apparatus as claimed in claim 2, wherein the track is disposed above the direction of inclination of the solids injection lance and comprises parallel rails.

4. Smelting apparatus as claimed in claim 1, wherein the carriage comprises upper and lower carriages disposed one above the other along the track.

5. Smelting apparatus as claimed in claim 4, wherein the lance connector comprises an upper connector for connecting the upper carriage to an upper end part of the solids injection lance and a lower connector for connecting the lower carriage to a part of the solids injection lance spaced downwardly from the upper end part of the solids injection lance.

6. Smelting apparatus as claimed in claim 5, wherein the upper connector provides a pivot connection between the upper carriage and the upper end of the solids injection lance and the lower connector is actuable to allow the solids injection lance to swing downwardly about the pivot connection to said upright position.

7. Smelting apparatus as claimed in claim 6, wherein the lower connector comprises a hoist actuable to lower the supported solids injection lance to the upright position.

8. Smelting apparatus as claimed in claim 7, wherein the hoist is connected to a hoist line or chain for connection with the solids injection lance.

9. Smelting apparatus as claimed in claim 8, wherein the hoist line or chain is connectable to the solids injection lance or passed around it as part of a sling support.

10. Smelting apparatus as claimed in claim 5, wherein the vessel includes a lance support in the form of a tubular nozzle and the solids injection lance includes at its upper end an outer sheath supportable within the nozzle and slidable therein on initial upward and outward movement of the solids injection lance to maintain support for the solids injection lance until the connection of the lower connector to the solids injection lance.

11. Smelting apparatus as claimed in claim 1, and further comprising a solids delivery line connected to the solids injection lance exteriorly of the vessel.

12. Smelting apparatus as claimed in claim 11, wherein the solids delivery line comprises a separable generally straight section connected to the solids injection lance and extending upwardly and outwardly from the side wall of the vessel beneath the track and the lance connector is alternatively operable to connect that delivery line section to the carriage to support that section from the track whereby to enable the delivery line section to be moved upwardly along the track and removed from the apparatus in an initial procedure before extraction of the solids injection lance.

13. Smelting apparatus as claimed in claim 12, wherein the connector is operable in the initial procedure to allow the delivery line section to be lowered to an upright position to which it can be lifted on the overhead crane or hoist.

14. Smelting apparatus as claimed in claim 1, further comprising an access tower surrounding the vessel for locating and supporting at least one said hoist so as to extend between a first end adjacent said vessel and a second end displaced upwardly and outwardly from said vessel, an upper portion of the vessel and an upper portion of said access tower extending vertically upwardly above the level of the second end of said hoist and the upper portion of said access tower being configured to allow at least one lance extraction envelope extending vertically upwardly above said second end of said hoist for removal of said solids injection lance and/or solids delivery line through said extraction envelope.

15. Smelting apparatus as claimed in claim 14 wherein at least part of the upper portion of the access tower above the second end of the hoist is displaced laterally from the second end of the hoist and wherein the extraction envelope comprises substantially the space extending laterally from the upper portion of the access tower to adjacent at least the second end of the hoists and extending upwardly from the second end of the hoists.

16. Smelting apparatus as claimed in claim 14, wherein a first platform is located on the access tower at a height adjacent said nozzles for locating said lances and at least a second platform is located vertically upwardly from the first platform; and wherein the hoist is located so as to pass through an aperture or recess in the second platform whereby the second end of the hoist is located vertically above the second platform.

17. Smelting apparatus as claimed in claim 16 wherein said aperture or recess is shaped to accommodate said solids injection lance when supported by said hoist so as to be substantially parallel to said hoist and when supported adjacent the second end of the hoist in a substantially vertical orientation.

18. Smelting apparatus as claimed in claim 16, wherein the second platform extends laterally from and vertically downwardly from a periphery of a third platform and said third platform is immediately above said first platform and located a predetermined minimum distance above said first platform.

19. A method of extracting a solids injection lance from a metallurgical vessel of a smelting apparatus, the metallurgical vessel for performing direct smelting to produce molten metal, the smelting apparatus including a downwardly extending gas injection lance for delivering a hot air blast into upper regions of the vessel and the solids injection lance in its operative position extending through a side wall of the vessel with downwards and inward inclination for injecting solids material into a molten bath contained within the vessel, said method comprising:

locating an elongate track so as to extend upwardly and outwardly of the vessel;

mounting a carriage on the track so as to be moveable along the track;

connecting the solids injection lance to the carriage so as to be supported from the track;

moving the carriage upwardly and outwardly along the track so as to extract the solids injection lance from the vessel while supported from the track;

lowering the solids injection lance to a generally upright position while supported from the track through connection to the carriage;

connecting an upper end of the solids injection lance to an overhead crane or hoist;

disconnecting the solids injection lance from the carriage; and lifting the solids injection lance in the generally upright position away from the vessel.

20. A method as claimed in claim 19, wherein the track is located adjacent and parallel with the direction of inclination of the solids injection lance.

21. A method as claimed in claim 20, wherein the track is located above the direction of inclination of the solids injection lance.

22. A method of removing, from a metallurgical vessel of a smelting apparatus within which to perform direct smelting to produce molten metal, a solids injection lance and a solids supply line section separably connectable to that lance, the solids injection lance having an operative position in which it extends through a side wall of the vessel for injecting solids material into a molten bath contained within a lower part of the vessel with the supply line section extending upwardly and outwardly exteriorly of the vessel in alignment with the solids injection lance, said method comprising the steps of:

locating an elongate track so as to extend upwardly and outwardly of the vessel above said supply line section;

mounting a carriage on the track so as to be moveable along the track;

connecting the supply line section to the carriage so as to be supported from the track;

lowering the supply line section to an upright position while supported from the track;

connecting the supply line section to an overhead crane or hoist;

disconnecting the line section from the carriage and lifting it away from the vessel on the overhead crane or hoist;

connecting the solids injection lance to the carriage;

moving the carriage upwardly and outwardly along the track to extract the solids injection lance from the vessel;

lowering the solids injection lance to an upright position whilst supported from the track;

connecting the solids injection lance to an overhead crane or hoist; and disconnecting the solids injection lance from the carriage and lifting it away from the vessel on the overhead crane or hoist.

23. A method as claimed in claim 22, and further comprising the step of moving the carriage along the track to move the supply line section upwardly and outwardly prior to lowering it to the upright position.

* * * * *